US008006530B2

(12) United States Patent
Tiprigan

(10) Patent No.: US 8,006,530 B2
(45) **Date of Patent: *Aug. 30, 2011**

(54) APPARATUS AND METHODS FOR MATERIAL FABRICATION

(75) Inventor: Dumitru Tiprigan, Waco, TX (US)

(73) Assignee: L-3 Communications Integrated Systems, L.P., Greenville, TX (US)

( * ) Notice: Subject to any disclaimer, the term of this patent is extended or adjusted under 35 U.S.C. 154(b) by 244 days.

This patent is subject to a terminal disclaimer.

(21) Appl. No.: 12/156,081

(22) Filed: May 29, 2008

(65) Prior Publication Data

US 2009/0320548 A1 Dec. 31, 2009

Related U.S. Application Data

(63) Continuation of application No. 11/372,244, filed on Mar. 9, 2006, now Pat. No. 7,401,487.

(51) Int. Cl.
*B21D 11/18* (2006.01)
*B21C 51/00* (2006.01)

(52) U.S. Cl. ..... 72/301; 72/311; 72/31.1

(58) Field of Classification Search ..... 72/31.02–31.05, 72/31.1, 380, 386, 411, 414, 301, 311, 295, 72/296, 385, 397, 460, 384, 309
See application file for complete search history.

(56) References Cited

U.S. PATENT DOCUMENTS

| | | | |
|---|---|---|---|
| 2,141,736 | A | 12/1938 | Castle et al. |
| 2,310,498 | A | 2/1943 | Turton |
| 2,433,808 | A | 12/1947 | Cadman |
| 2,479,161 | A | 8/1949 | Hall |
| 2,670,779 | A | 3/1954 | Mowrey |
| 2,767,763 | A | 10/1956 | Anderson |
| 2,792,044 | A | 5/1957 | Strom |
| 2,868,264 | A | 1/1959 | Jones |
| 2,886,092 | A | 5/1959 | Jelinek |
| 2,910,108 | A | 10/1959 | Fike |
| 3,827,278 | A | 8/1974 | Mershon et al. |
| 4,276,762 | A | 7/1981 | Mershon et al. |
| 4,774,994 | A | 10/1988 | Darter et al. |
| 5,237,846 | A | 8/1993 | Brooks, Jr. |
| 5,865,056 | A | 2/1999 | Nagakura |
| 6,178,799 | B1 | 1/2001 | Miller et al. |
| 6,711,931 | B2 | 3/2004 | Calder et al. |
| 6,935,154 | B2 | 8/2005 | Calder et al. |
| 2007/0209421 | A1 | 9/2007 | Tiprigan |

OTHER PUBLICATIONS

Search Report, PCT/US07/03074; Jul. 21, 2008; 4 pgs.
Tiprigan, U.S. Appl. No. 11/372,244, Office Action, Jul. 2, 2007, 7 pgs.
Tiprigan, U.S. Appl. No. 11/372,244, Amendment and Response to Office Action, Sep. 14, 2007, 32 pgs.
Tiprigan, U.S. Appl. No. 11/372,244, Office Action, Dec. 3, 2007, 7 pgs.

(Continued)

*Primary Examiner* — Debra Sullivan
(74) *Attorney, Agent, or Firm* — O'Keefe, Egan, Peterman & Enders LLP

(57) ABSTRACT

Apparatus and methods for fabricating materials by die-forming that may be implemented to form a joggle in a bendable workpiece by securing the workpiece to each of at least two respective adjacent working areas, and then by displacing at least one of the at least two working areas relative to an adjacent working area in order to induce the joggle within the workpiece.

25 Claims, 24 Drawing Sheets

OTHER PUBLICATIONS

Tiprigan, U.S. Appl. No. 11/372,244, Amendment and Response to Office Action, Mar. 3, 2008, 17 pgs.

Tiprigan, U.S. Appl. No. 11/372,244, Notice of Allowance, May 5, 2008, 4 pgs.

Tiprigan, U.S. Appl. No. 11/372,244, Amendment After Allowance Under 37 CFR 1.312, May 16, 2008, 19 pgs.

APPARATUS AND METHODS FOR MATERIAL FABRICATION

CROSS-REFERENCE TO RELATED APPLICATIONS

This application is a continuation application of U.S. patent application Ser. No. 11/372,244 filed Mar. 9, 2006, now U.S. Pat. No. 7,401,487 the disclosure of which is expressly incorporated herein by reference in its entirety.

FIELD OF THE INVENTION

This invention relates generally to material fabrication, and more particularly to apparatus and methods for bending or otherwise die-forming materials.

BACKGROUND OF THE INVENTION

In the aircraft industry, bendable metal parts are often die-formed to displace and bend one portion of a given part relative to another portion of the same part. A joggle is formed by a combination of two bends within a given part that displaces a second portion of the part relative to a first portion of the part so that the two portions of the part lie in parallel, but different, planes. Joggles are utilized to form mating parts that may be assembled together on an aircraft in a closely-fitting manner that reduces stress between the parts due to vibration during operation of the aircraft. For example, joggles may be used to create a close-fitting and flat mounting surface on an aircraft for electronic equipment. On a given aircraft, it is not uncommon for a unique joggle configuration to be required for at different joggle locations on the aircraft. Each unique joggle configuration may include a unique combination of displacement angle and displacment distance.

A joggle is conventionally formed by pressing a metal part between the appropriately shaped surfaces of two (i.e., male and female) joggle dies within a die press until the desired displacement of the part is achieved. In this conventional operation, the shapes of the mating die surfaces correspond to the particular joggle configuration being formed. Therefore, each unique joggle configuration requires a unique pair of mating joggle die. These mating joggle die are typically custom machined, e.g., from two aluminum blocks. The large number of unique joggle configurations that are often required on a given aircraft typically requires a correspondingly large number of joggle die pairs to be custom manufactured. This process is time-consuming, taking several hours to custom manufacture each joggle die pair. Furthermore, more than one size of hydraulic die press may be required to handle the widths of different joggle dies that may be required in joggle-forming operations for a single aircraft. This requires significant investment and maintenance for mulitple die press systems.

SUMMARY OF THE INVENTION

Disclosed herein are apparatus and methods for fabricating materials by die-forming. The disclosed apparatus and methods may be implemented to form a joggle in a bendable workpiece (e.g., metal workpiece, aluminum or steel extrusion, plastic or Teflon® laminate, etc.) by securing the workpiece to each of at least two respective adjacent working areas, and then by displacing at least one of the at least two working areas relative to an adjacent working area in order to induce the joggle within the workpiece. The disclosed apparatus and methods of may be advantageously implemented in one embodiment to induce bends of substantially equal angular and linear displacement in each of two or more of the multiple sections of a multi-planar bendable workpiece (i.e., a bendable workpiece having two or more sections that are oriented in different planes from each other) by securing each of the two or more sections of the multi-planar bendable workpiece against at least one working surface of a working area prior to displacing at least one of the working areas relative to an adjacent working area to induce substantially equal angular displacement in each of the two or more sections of the multi-planar bendable workpiece.

In one exemplary embodiment, the disclosed apparatus and methods may be implemented to form a joggle in an elongated bendable workpiece (e.g., strap or sheet metal workpiece, angle iron metal workpiece, plastic or Teflon® laminate, etc.) by securely placing the workpiece within respective die platform working areas (e.g., die platform cavities, die platform channels, etc.) provided on each of at least two adjacent and separate die platform assemblies, securing the workpiece to each of the die platform working areas using a movable workpiece die, and then by displacing at least one of the die platform working areas relative to the other die platform working area in order to induce the joggle within the workpiece. In this embodiment, the workpiece die of each of the die platform assemblies may be biased against at least one working surface of its die platform working area with the workpiece positioned therebetween in a secure vise-like manner prior to displacing at least one of the die platform working surfaces relative to the other die platform working surface.

In one exemplary embodiment, one or more of the die platform working areas may be configured to be open on at least one side to receive a bendable workpiece, and may be further configured to remain open on at least one side at the same time the workpiece is secured to the die platform working area and at the same time that at least one of the working areas is displaced relative to the other working area. In such an exemplary configuration, the workpiece may be viewed for alignment purposes during the placement and securing of the workpiece to the die platform working areas, and during the displacement and bending operations that follow, e.g., so that the progress of the joggle-forming operation may be visually followed and/or measured if so desired. In this regard, an optional alignment scale or other visual alignment index may be provided to align the workpiece in secure relationship with the die platform areas, e.g., without using a mechanical alignment device such as a back gauge device. Additionally or alternatively, an optional displacement scale or other type of visual displacement indicator may be provided to indicate displacement of one die placement working area relative to the other die placement working area during the joggle-forming operation so that the amount of angular bend imparted to the workpiece may be measured during the joggle-forming operation. In one exemplary embodiment, a dynamic displacement indicator, such as an analog displacement dial or digital displacement indicator may be provide for indicating displacement of one die placement working area relative to the other die placement working area.

The disclosed apparatus and methods of may be further advantageously implemented in one embodiment to induce bends of substantially equal angular and linear displacement in each of two or more of the multiple portions of a bendable workpiece configured with a multi-planar shape, e.g., such as an angle iron workpiece having two perpendicularly-oriented side member sections joined at an intersecting corner. When used to form joggles within such multi-planar workpieces, the workpiece die of each of the die platform assemblies may be employed to secure each of two or more multiple sections of a bendable multi-planar workpiece that are oriented in different planes (e.g., each outside side member section of the two perpendicularly-oriented side member sections of an angle iron workpiece) against at least one working surface of its respective die platform working area in a secure vise-like manner prior to displacing at least one of the die platform working areas relative to the other die platform working area to induce substantially equal angular displacement in each of the two or more multiple sections of the multi-planar bendable workpiece.

In one embodiment, use of the disclosed apparatus and methods advantageously allows one set of workpiece dies to be employed to die-form a range of workpiece sizes and shapes, and/or for forming a variety of different joggle configurations in a given workpiece without the need for unique tooling. In this regard, a given workpiece die need only be suitable for securing one or more sections of a single plane or multi-planar workpiece against at least one working surface of its respective die platform working area to enable die forming operations as described elsewhere herein. Thus, the disclosed apparatus and methods without the use of tooling and brakepress equipment, and may be implemented in a manner that significantly reduces time and materials as compared to conventional die-forming operations that require custom manufactured male and female dies to be fabricated for each different joggle configuration. For example, in one exemplary embodiment, the disclosed apparatus and methods may be implemented to form a joggle in a workpiece in less than about one hour, as compared to a joggle-forming time of from about two to about six hours for a conventional die-forming operation that utilizes custom manufactured male and female dies.

In one respect, disclosed herein is a die-forming apparatus, including: a first die platform, the first die platform including a first working member and a first securing member oriented in spaced relationship with the first working member so as to define a first working area therebetween; a second die platform disposed adjacent to the first die platform, the second die platform including a second working member and a second securing member oriented in spaced relationship with the second working member so as to define a second working area therebetween; and at least one workpiece die configured to be positioned within at least one of the first and second working areas. At least one of the first and second die platforms may be movable relative to the other of the first and second die platforms so that the first and second working areas are positionable in an aligned relationship with each other, and at least one of the first and second die platforms may be movable relative to the other of the first and second die platforms so that the first and second working areas are positionable from the aligned relationship to a non-aligned relationship with each other.

In another respect, disclosed herein is a die-forming apparatus, including: a first working area provided with a first working surface, the first working area configured to receive a first workpiece die and a first portion of a bendable workpiece between the first workpiece die and the first working surface of the first working area; and a second working area disposed adjacent to the first working area and provided with a first working surface, the second working area configured to receive a second workpiece die and a second portion of the bendable workpiece between the second workpiece die and the first working surface of the second working area. The second working area may be displaceable with the second workpiece die relative to the first working area with the first workpiece die when the first portion of the bendable workpiece is received between the first workpiece die and the first working surface of the first working area, and when the second portion of the bendable workpiece is received between the second workpiece die and the first working surface of the second working area so as to induce a bend in the bendable workpiece.

In another respect, disclosed herein is a method of die-forming a bendable workpiece, including: positioning the bendable workpiece within first and second working areas, the second working area being disposed adjacent to the first working area; positioning a workpiece die within at least one of the first or second working areas so that a portion of the bendable workpiece is positioned between the workpiece die and a first working surface of at least one of the first or second working areas; and inducing a bend in the bendable workpiece by displacing the second working area relative to the first working area with the portion of the bendable workpiece positioned between the at least one workpiece die and the first working surface of the first or second working areas.

DESCRIPTION OF ILLUSTRATIVE EMBODIMENTS

Figure 1A:
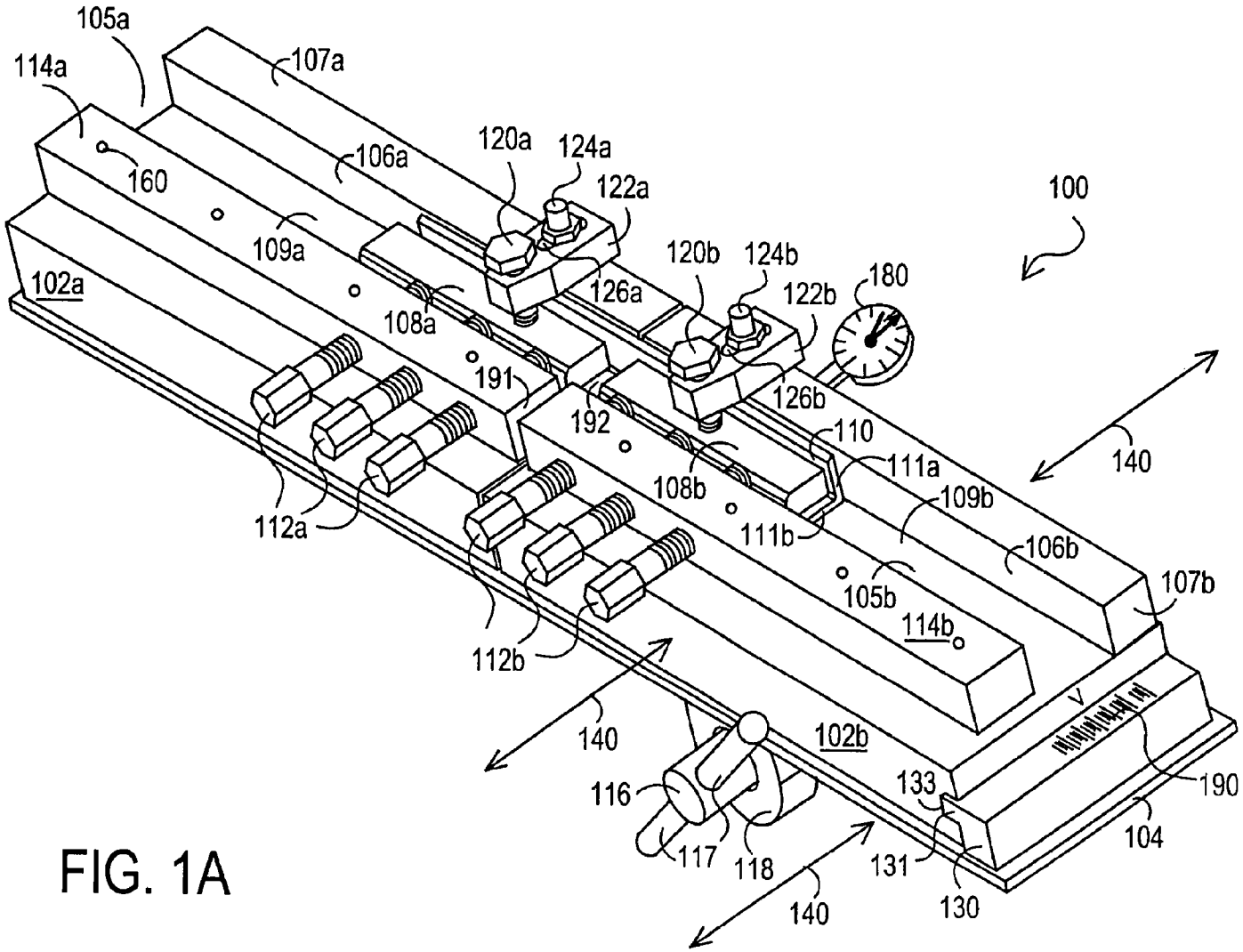
FIG. 1A is a perspective view of a die-forming apparatus configured according to one exemplary embodiment of the disclosed apparatus and methods.

FIGS. 1-5 illustrate a die-forming apparatus 100 as it may be configured according to one exemplary embodiment of the disclosed apparatus and methods. As shown in FIGS. 1-5, die-forming apparatus includes a stationary first die platform 102*a* and a movable second die platform 102*b* that are adjacently disposed on platform support base 104. Stationary first die platform 102*a* includes an elongated working member 107*a* providing a first working surface 106*a*, and an elongated securing member 114*a* oriented in spaced parallel relationship with elongated working member 107*a* so as to define a first channel-shaped working area 105*a* therebetween. In the illustrated exemplary embodiment, elongated securing member 114*a* is shown mechanically coupled to die platform 102*a* by bolts 160, although it will be understood that elongated securing member 114*a* may be coupled to die platform 102*a* using any other suitable form of fastener, weld, etc. or may be formed as an integral part of die platform 102*a*. It will be understood that elongated working member 107*a* may be similarly coupled or formed as a part of die platform 102*a*.

Stationary first die platform 102*a* is coupled to platform support base 104 in stationary relationship, i.e., so that it does not move relative to platform support base 104. In such an embodiment, stationary die platform 102*a* may be provided, for example, to assist in proper line up of die platforms 102*a* and 102*b* with a workpiece prior to die-forming operations, thus reducing set up time and facilitating formation of more accurate joggles. It will be understood, however, that the disclosed apparatus and methods may be implemented in another embodiment with two movable die platforms 102 that are adjacently disposed on platform support base 104, and that the disclosed die forming operations may be performed using the apparatus of such an embodiment by moving either one or both of the movable die platforms 102 relative to each other.

Still referring to FIGS. 1-5, movable second die platform 102*b* includes an elongated working member 107*b* providing a second working surface 106*b*, and an elongated securing member 114*b* oriented in spaced parallel relationship with elongated working member 107*b* so as to define a second channel-shaped working area 105*b* therebetween that is positionable in an aligned relationship with first channel-shaped working area 105*a* as shown in FIGS. 1-5. In the illustrated exemplary embodiment, elongated securing member 114*b* is shown mechanically coupled to die platform 102*b* by bolts 160, although it will be understood that elongated securing member 114*b* may be coupled to die platform 102*b* using any other suitable form of fastener, weld, etc. or may be formed as an integral part of die platform 102*b*. It will be understood that elongated working member 107*b* may be similarly coupled or formed as a part of die platform 102*b*.

In one exemplary embodiment, elongated securing members 114*a* and 114*b* may be movably coupled relative to respective die platforms 102*a* and 102*b*, so that elongated securing members 114*a* and 114*b* may be selectively positioned and secured to respective die platforms 102*a* and 102*b* at variable distances apart from each other, e.g., by loosening and repositioning threaded mounting bolts 160 in alternate internally threaded holes or in elongated mounting slots that may be provided in respective die platforms 102*a* and 102*b*. In one exemplary embodiment using such variable positioning capability, joggle transitions having a length L of from about 0.125 inches to about 4 inches may be made possible. In another embodiment, joggle transitions having a length (L) (see FIG. 8) of from about 0.125 inches to about 6 inches may be made possible, e.g., by addition of additional outboard mounting bolts 160 to allow elongated securing members 114*a* and 114*b* to be moved further apart from each other. However, it will be understood that joggle transitions having lengths less than about 0.125 inches and greater than about 6 inches are possible in other embodiments.

Second die platform 102*b* is movably coupled to platform support base 104 so that it is movable relative to support base 104 and stationary first die platform 102*a* in a direction perpendicular to the longitudinal axes of first and second channel-shaped working areas 105*a* and 105*b*, and in a direction perpendicular to first and second working surfaces 106*a* and 106*b*, as indicated by arrows 140. In this regard, second die platform 102*b* may be movably coupled to support base 104 in any suitable manner.

In the illustrated embodiment shown in FIGS. 1-5, a stationary guide member 130 may be secured to platform base 104 and may be provided with a tongue 131 that is slidingly received within a correspondingly dimensioned groove 133 provided in the side of movable second die platform 102*b*. As so configured, stationary guide member 130 acts to contact and contain the right side of movable second die platform 102*b* so as to prevent movable second die platform 102*b* from moving to the right and away from stationary first die platform 102*a* during die-forming operations. As will be described further herein, an internally threaded drive nut 150 may be coupled to the underside of movable second die platform 102*b* through a slotted opening 103 defined in platform support base 104. By virtue of a close (e.g., precision) fit of drive nut 150 within a slotted opening 103 defined in support base 104, movable die platform 102*b* may be prevented from moving to the left and toward stationary first die platform 102*a* during die-forming operations. Together, drive nut 150 and guide member 130 may cooperate to maintain movable die platform 102*b* in substantially parallel relation, and at a substantially fixed distance from, stationary first die platform 102*a* as movable die platform 102*b* is moved in relation to first die platform 102*a* during die-forming operations.

Components of first and second die platforms 102*a* and 102*b* may be constructed of any material or combination of materials suitable for cooperating to perform the die-forming operations described herein for a given type of bendable workpiece material/s. In one exemplary embodiment, individual components of first and second die platforms 102*a* and 102*b* may be constructed of machined steel that may be employed for die-forming of steel workpieces. In another exemplary embodiment, individual components of first and second die platforms 102*a* and 102*b* may be constructed of machined aluminum that may be employed for die-forming of relatively softer workpiece materials (e.g., plastic or Teflon® laminate).

Figure 12:
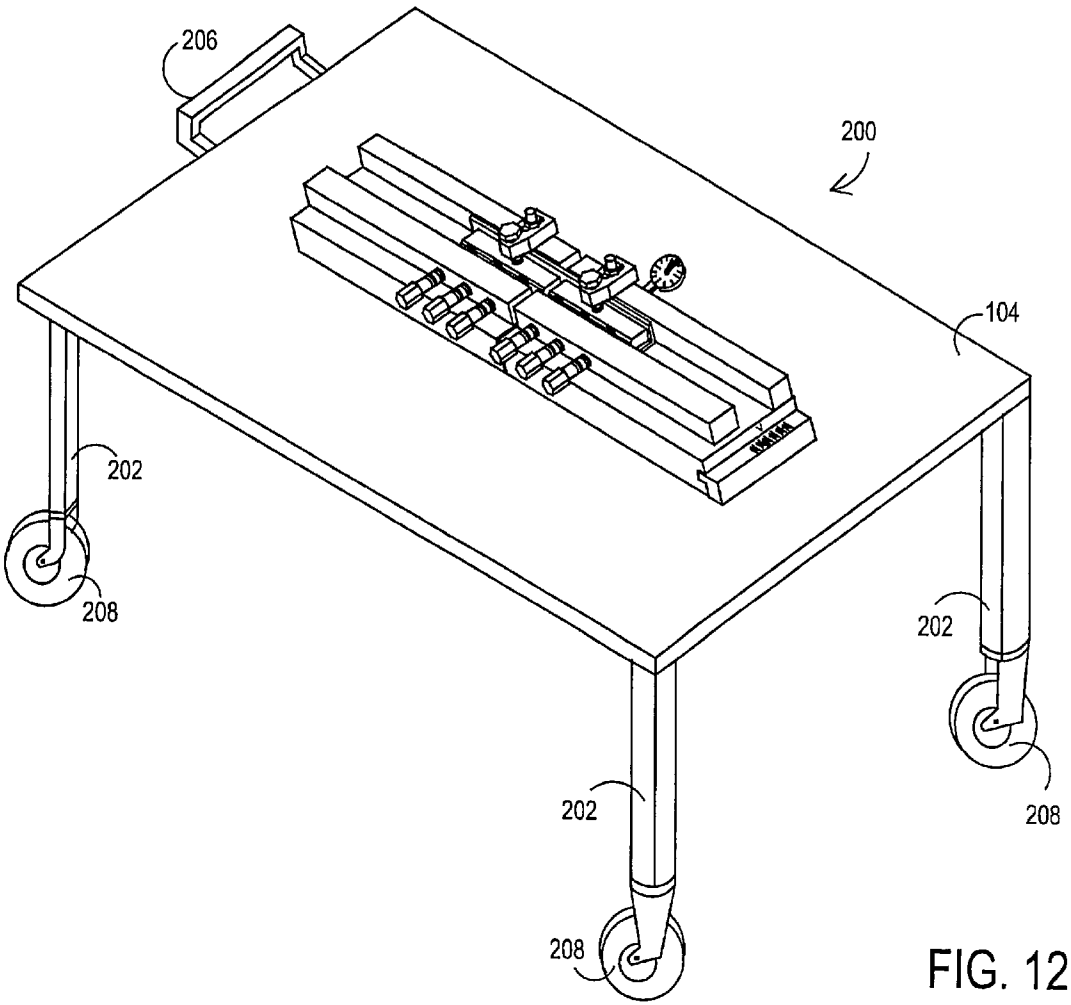
FIG. 12 is a perspective view of a portable die-forming apparatus configured according to one exemplary embodiment of the disclosed apparatus and methods.

Platform support base 104 may be any structure suitable for operably supporting first and second die platforms 102*a* and 102*b*, for example, configured as work table (e.g., from about ¾" to about ½" thick steel plate coupled to supporting legs) or as permanent workshop fixture secured to the floor or walls of workshop. In one exemplary embodiment, a portable die-forming apparatus may be provided that may be moved between work locations for purposes of convenience, e.g., as a portable work table having removable legs, and/or legs provided with rollers or wheels. For example, when forming joggled workpieces in the aviation industry, such a portable die-forming apparatus may be moved from aircraft to aircraft, and positioned adjacent, under, or even brought aboard an individual aircraft, when forming joggled workpieces for that individual aircraft. FIG. 12 illustrates one exemplary embodiment of portable die-forming apparatus 200 having a support base 104 coupled to four legs 202. As shown, the end of each of leg 202 is provided with a swiveling wheel assembly 208 that allows die-forming apparatus 200 to be moved between work locations. A handle 206 for manually pushing/pulling apparatus 200 is also shown provided in FIG. 12.

Figure 1B:
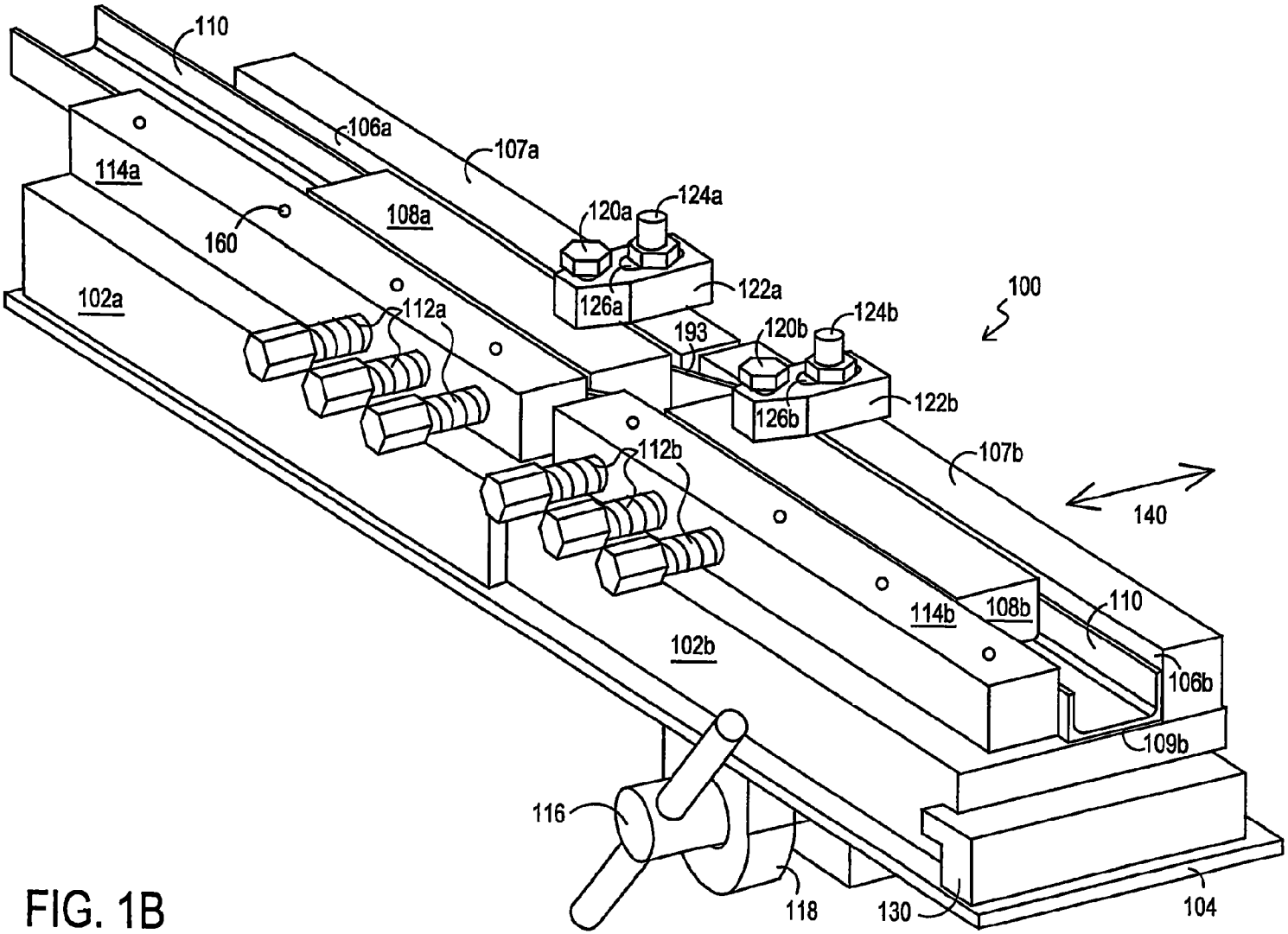
FIG. 1B is a perspective view of a die-forming apparatus configured according to one exemplary embodiment of the disclosed apparatus and methods.
Figure 1C:
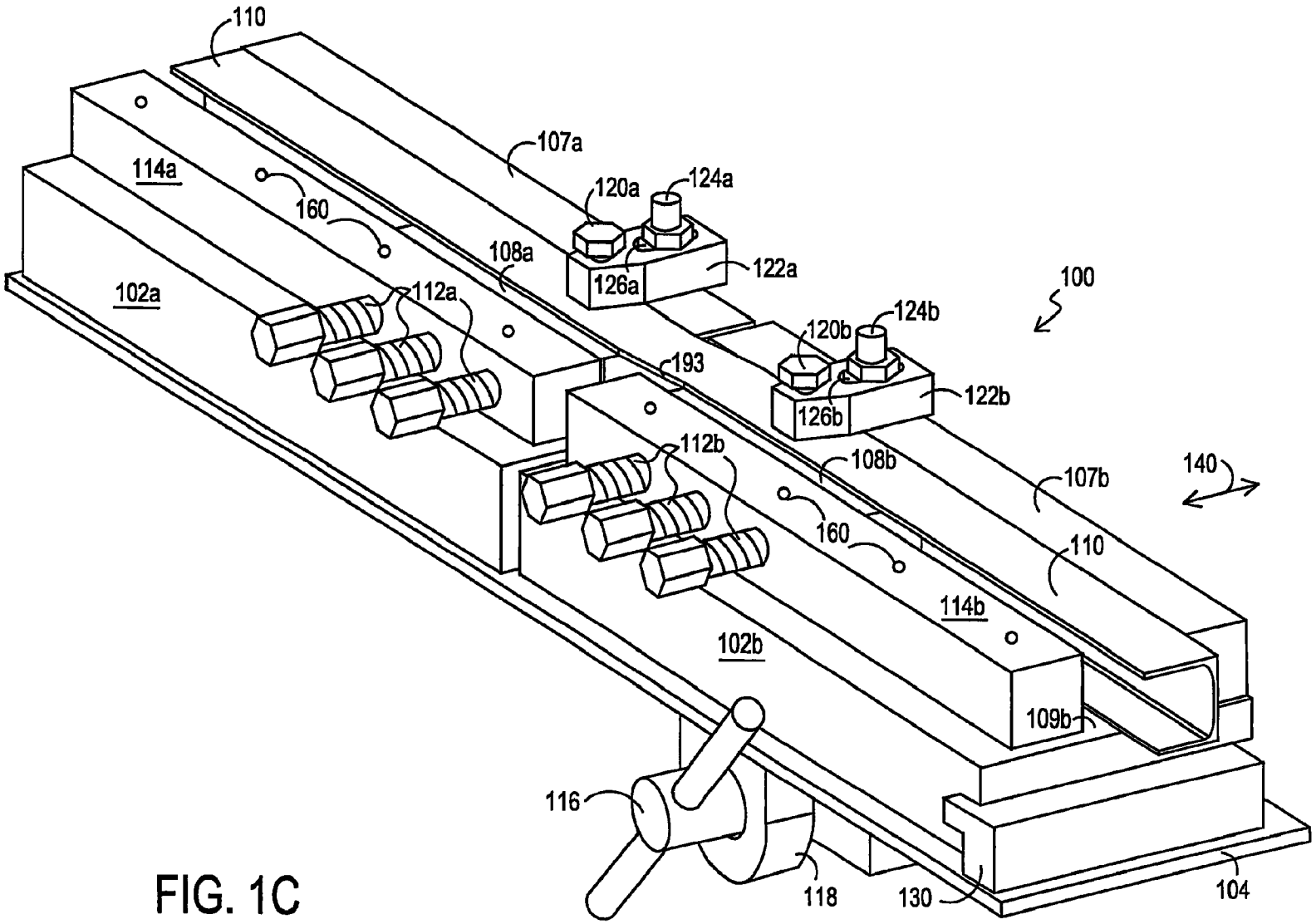
FIG. 1C is a perspective view of a die-forming apparatus configured according to one exemplary embodiment of the disclosed apparatus and methods.

In the exemplary embodiment of FIGS. 1A and 2-5, an unbent multi-planar elongated bendable workpiece 110 in the form of an elongated piece of angle iron is shown positioned within first and second channel-shaped working areas 105*a* and 105*b* so that the longitudinal axis of workpiece 110 is aligned in substantially parallel relationship with the longitudinal axis of each of working areas 105*a* and 105*b*, and so that the outside surface of first one of the perpendicularly-oriented side member sections 111*a* of angle iron workpiece 110 is in contact with side working surfaces 106*a* and 106*b*, and so that the outside surface of the second one of the perpendicularly-oriented side member sections 111*b* of angle iron workpiece 110 is in contact with base working surfaces 109*a* and 109*b*. As such, FIGS. 1-5 show workpiece 110 as it may be positioned in die-forming apparatus 100 prior to performing die-forming operations on workpiece 110. FIGS. 1B and 1C illustrate another example of workpiece shape that may be die-formed using the disclosed apparatus and methods. In this regard, workpiece 110 of FIGS. 1B and 1C is an elongated piece of channel iron. As further shown by FIGS. 1B and 1C, workpiece 110 may be positioned in different ways within first and second channel-shaped working areas 105*a* and 105*b*, e.g., so as to form a joggles of different orientation within the workpiece.

It will be understood that the particular illustrated configuration of elongated channel-shaped working areas 105*a* and 105*b* is exemplary only, and that any other configuration may be implemented that provides first and second side working surfaces side working surfaces 106*a* and 106*b* and first and second base working surfaces 109*a* and 109*b* capable of movement relative to each other to die-form a workpiece in a manner as described elsewhere herein.

As shown in FIGS. 1-5, a first workpiece die 108*a* is disposed within first working area 105*a* between securing member 114*a* and working member 102*a*, and with a first perpendicularly-oriented side member section 111*a* of workpiece 110 disposed between die 108*a* and side working surface of 106*a* and with a second perpendicularly-oriented side member section 111*b* of workpiece 110 disposed between die 108*a* and base working surface 109*a*. Similarly, a second workpiece die 108*b* is disposed within second working area 105*b* between securing member 114*b* and working member 102*b*, and with the first perpendicularly-oriented side member section 111*a* of workpiece 110 disposed between die 108*b* and side working surface 106*b* and with second perpendicularly-oriented side member section 111*b* of workpiece 110 disposed between die 108*b* and base working surface 109*b*. In one embodiment, dimensions and shape of one or more surfaces of a workpiece die may be configured substantially complementary to shape and dimensions of one or more internal surfaces of a workpiece. For example, referring to FIGS. 1-5, where a radial and concave-shaped inner surface of work piece 110 is optionally formed at the line of intersection between perpendicularly-oriented side member sections 111*a* and 111*b*, each of workpiece die 108*a* and 108*b* may be configured with a corner having a complementary radial and convex shape that is configured for substantially tight and conformal mating with the radial and concave inner surface of workpiece 110 during joggle-forming operations.

As shown in FIGS. 1-5, a gap 192 exists between die 108*a* and 108*b* that corresponds to the location of a joggle to be formed in workpiece 110. In this regard, gap 192 may or may not coincide or be substantially aligned with gap 191 existing between stationary first die platform 102*a* and movable second die platform 102*b* during die-forming operations. The length (L) 199 (see FIG. 8) of a joggle transition formed during joggle-forming operations corresponds with the width of gap 192 during joggle-forming operations, so that L may be varied by changing the width of gap 192.

In the exemplary embodiment of FIGS. 1-5, die securing devices in the form of threaded bolts 112*a* extending through complementary internal threaded apertures in securing member 114*a* are present to bias workpiece die 108*a* against side working surface 106*a* with a part of a first side member section of workpiece 110 positioned therebetween in a secure vise-like manner, and die securing devices in the form of threaded bolts 112*b* extending through complementary internal threaded apertures in securing member 114*b* are present to bias workpiece die 108*b* against side working surface 106*b* with another part of the first side member section of workpiece 110 positioned therebetween in a secure vise-like manner.

Also shown present in this exemplary embodiment is first adjustable support bracket 122*a* that is adjustably attached to an upper surface of working member 107*a* in a cantilevered manner above working area 105*a* as shown with an adjustable fastening nut and bolt 124*a* received through an elongated adjustment slot 126*a* defined in first adjustable support bracket 122*a*. Similarly, second adjustable support bracket 122*b* is shown adjustably attached to an upper surface of working member 107*b* in a cantilevered manner above working area 105*b* with adjustable fastening nut and bolt 124*b* received through an elongated adjustment slot 126*b* defined in second adjustable support bracket 122*b*. Die securing device 120*a* in the form of a threaded bolt is provided as shown extending downwardly from first adjustable support bracket 122*a* into working area 105*a* to bias workpiece die 108*a* against base working surface 109*a* with a part of a second side member section of workpiece 110 positioned therebetween in a secure vise-like manner, and a similar die securing device 120*b* is likewise provided as shown extending downwardly from second adjustable support bracket 122*b* into working area 105*b* to bias workpiece die 108*b* against base working surface 109*b* with a part of a second side member section of workpiece 110 positioned therebetween in a secure vise-like manner. Adjustment slots 126 allow position of support brackets 122 and die securing devices 120 to be varied to accommodate different thicknesses and shapes of workpieces.

Although FIGS. 1-5 illustrate a multiplanar workpiece 110 operably disposed within working areas 105*a* and 105*b* of die-forming apparatus 100, it will be understood that the disclosed method and apparatus may also be implemented to die-form single plane workpieces, such as elongated strap or sheet metal pieces. In this regard, a single plane workpiece may be positioned within each of working areas 105 so that it is either disposed in a single plane between each die 108 and a respective side working surface 106, or disposed in single plane between each die 108 and a respective base working surface 109. In such a single plane die-forming application, each workpiece die 108 may only be secured against one working surface 106 or 109 with the single plane of the workpiece positioned therebetween, and each die 108 may or may not be secured against the other working surface 106 or 109, i.e., without the workpiece positioned therebetween.

It will be understood that the particular configuration of threaded bolts 112, adjustable support brackets 122, adjustable fastening nut and bolts 124 and die securing devices 120 illustrated in FIGS. 1-5 are exemplary only, and that any other form of die securing device configuration or other suitable securing methodology may be employed to secure a workpiece die against one or more working surface/s of a die platform with a part of a workpiece positioned therebetween. In this regard, it will be understood that it is possible that die-forming operations may be carried out on a multi-planar workpiece with only one plane of the multi-planar workpiece being secured with a die against one working surface (e.g., either side or base working surface) with the one plane of the multi-planar workpiece positioned therebetween.

As shown in the exemplary embodiment of FIGS. 1-5, die-forming apparatus 100 is provided with a die platform drive assembly that includes an externally threaded drive pin 152 that is received in an internally threaded drive nut 150. Internally threaded drive nut 150 is in turn mechanically coupled to movable second die platform 102*b* through a slotted opening 103 defined in platform support base 104. As shown, a second end of drive pin 152 is rotatably received in second pin support member 119, and a portion of the body of drive pin 152 is rotatably received in first pin support member 118 at a point between drive nut 150 and first end 116 of drive pin 152. Drive handles 117 are provided on first end of drive pin 152 for facilitating manual rotation of drive pin 152 about its axis within first and second pin support members 118 and 119 and within drive nut 150 in order to bidirectionally displace drive nut 150 and movable second die platform 102*b* relative to first die platform 102*a* in the direction of arrows 140.

It will be understood that the illustrated configuration of die platform drive assembly is exemplary only, and that any other die platform assembly configuration may be employed that is suitable for manually or automatically displacing movable second die platform 102*b* relative to first die platform 102*a* in the direction of arrows 140. For example, drive pin 152 may be rotated about its axis by hydraulic actuator or using an electric motor. In another possible configuration, a hydraulic piston and cylinder may be employed to displace movable second die platform 102*b* relative to first die platform 102*a* in the direction of arrows 140.

In one exemplary embodiment, an optional displacement indicator may be provided to indicate the amount that movable second die platform 102*b* has been moved from a first position to a second position relative to first die platform 102*a* in the direction of arrows 140. Such displacement indicator may be so employed to measure, and thus control, the amount of bend or joggle that has been induced in a workpiece by movement of movable second die platform 102*b* from the first position to the second position, e.g., without requiring a back gauge device and the time needed to operate such a device. In the illustrated exemplary embodiment of FIGS. 1-5, a displacement indicator is shown in the form of a mechanical dial indicator 180 that is configured to measure displacement of movable second die platform 102*b* from the first position to the second position by, e.g., from about 0.050 inch to about 1.000 inch. Dial indicator 180 may be, for example, a dial indicator device that is mounted on a magnetic base which may be magnetically attached to platform support base 104 so that the measuring point of the dial indicator device contacts the back side of movable second die platform 102*b*. As second die platform 102*b* is moved toward or away from the indicator device, the amount that second die platform 102*b* has been moved or displaced from a first position to a second position is reflected by a corresponding movement of the measurement needle of the dial indicator 180.

It will be understood that illustrated dial indicator 180 is exemplary only, and that any other type (e.g., mechanical, electronic, etc.) of displacement indicator may be employed that is suitable for indicating the amount that movable second die platform 102*b* has been moved from a first position to a second position relative to first die platform 102*a* in the direction of arrows 140. For example, in one exemplary embodiment, an optional scale (e.g., scale 190 of FIG. 1) may be provided on one surface (movable or stationary surface) for visually indicating displacement of movable second die platform 102*b* relative to first die platform 102*a*.

Figure 6A:
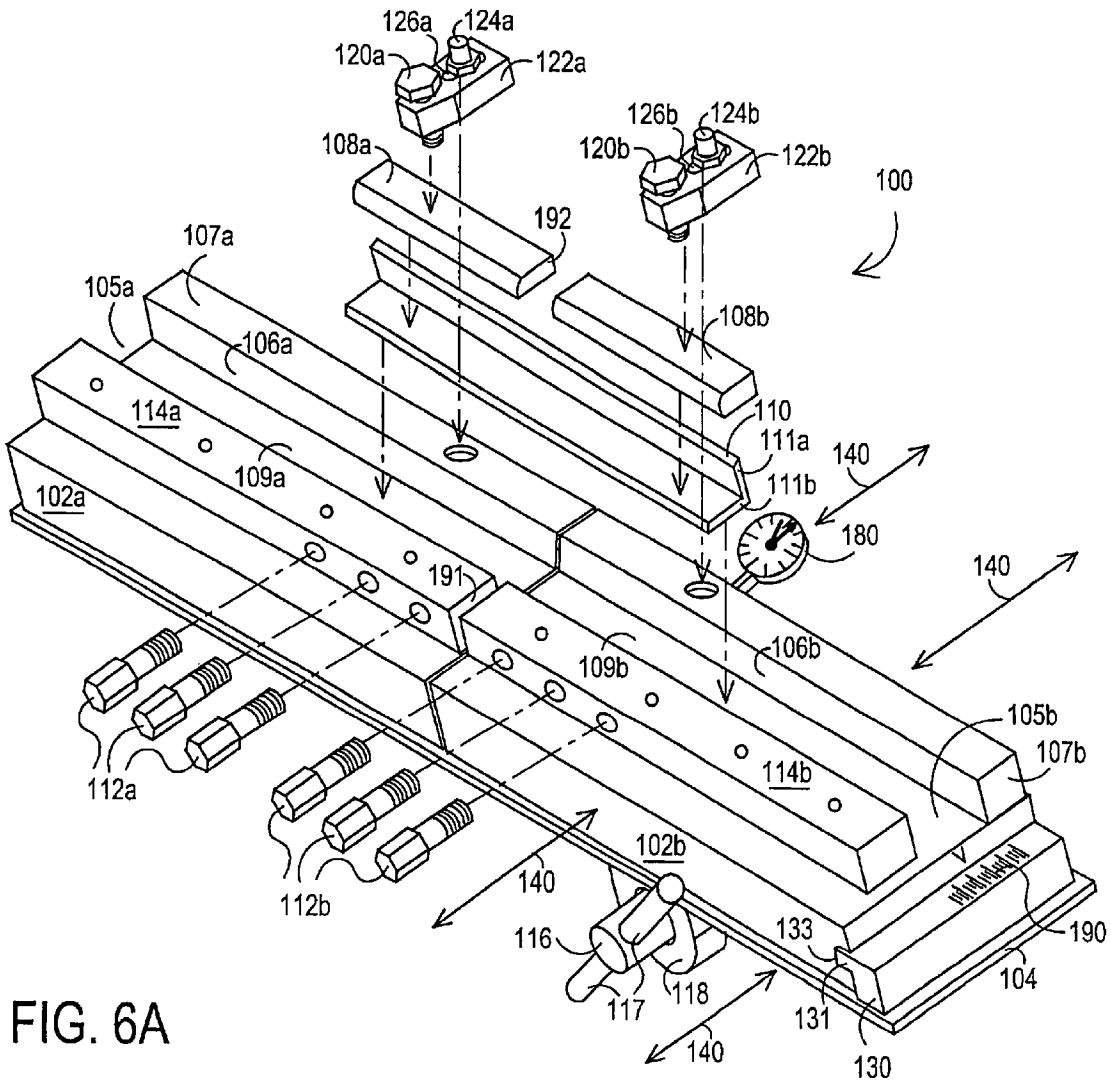
FIG. 6A is an exploded perspective view of a die-forming apparatus configured according to one exemplary embodiment of the disclosed apparatus and methods.

FIG. 6A illustrates an exploded perspective view of die-forming apparatus 100 of FIGS. 1-5, showing relative spatial positioning of workpiece 110 and various components of die-forming apparatus 100 in relation to each other. As may be seen from FIG. 6, workpiece 110 may be placed from the top and/or side into channel-shaped working areas 105*a* and 105*b*, and then workpiece dies 108*a* and 108*b* placed into position on top of workpiece 110 prior to tightening down the die securing devices to secure the die and workpiece in place.

Figure 6B:
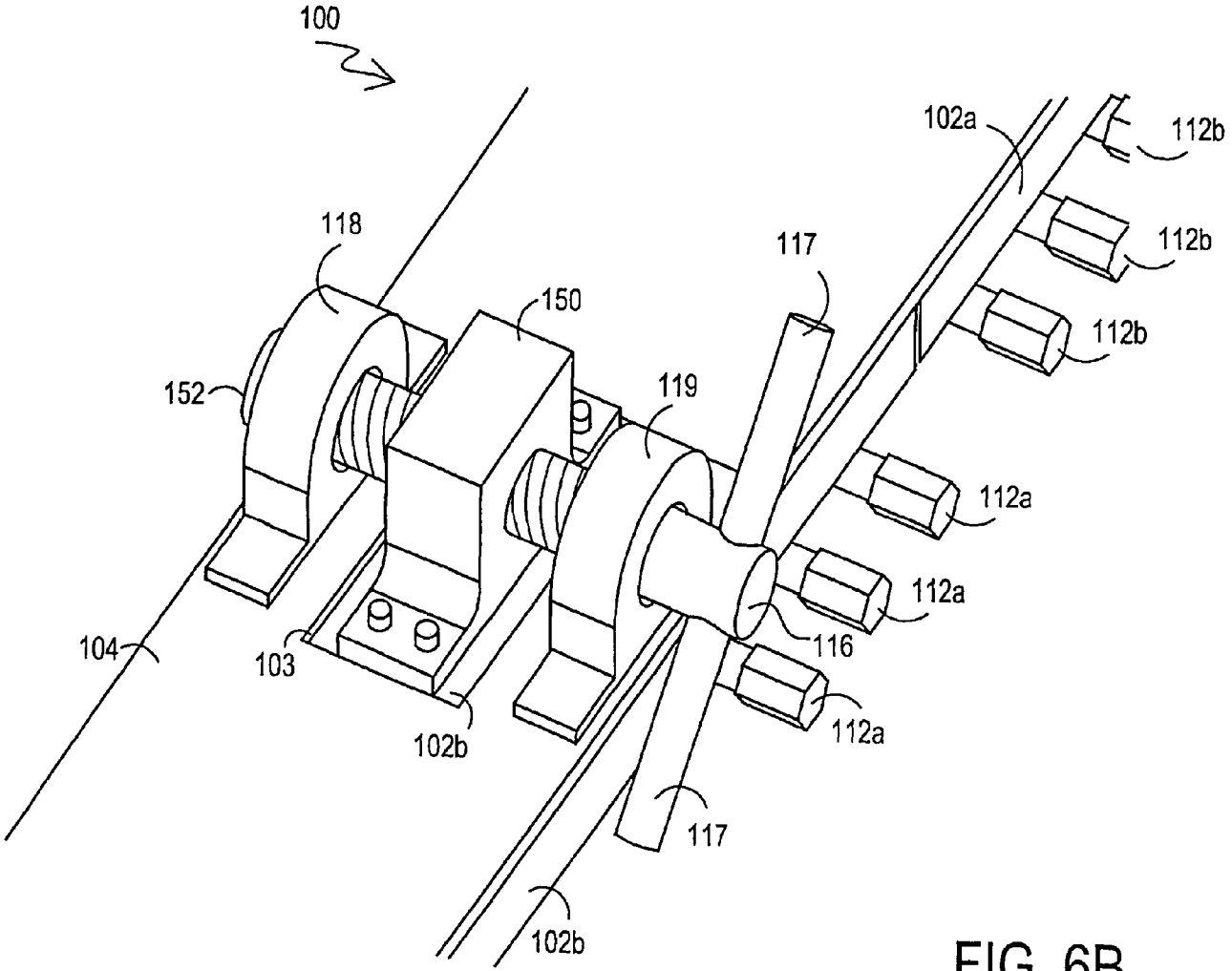
FIG. 6B is a partial bottom perspective view of a die-forming apparatus configured according to one exemplary embodiment of the disclosed apparatus and methods.

Alternatively, workpiece 110 and workpiece dies 108*a* and 108*b* may be placed together into working areas 105*a* and 105*b* prior to tightening down the die securing devices. FIG. 6B is a partial bottom perspective view of die-forming apparatus 100 of FIG. 6A.

Figure 2:
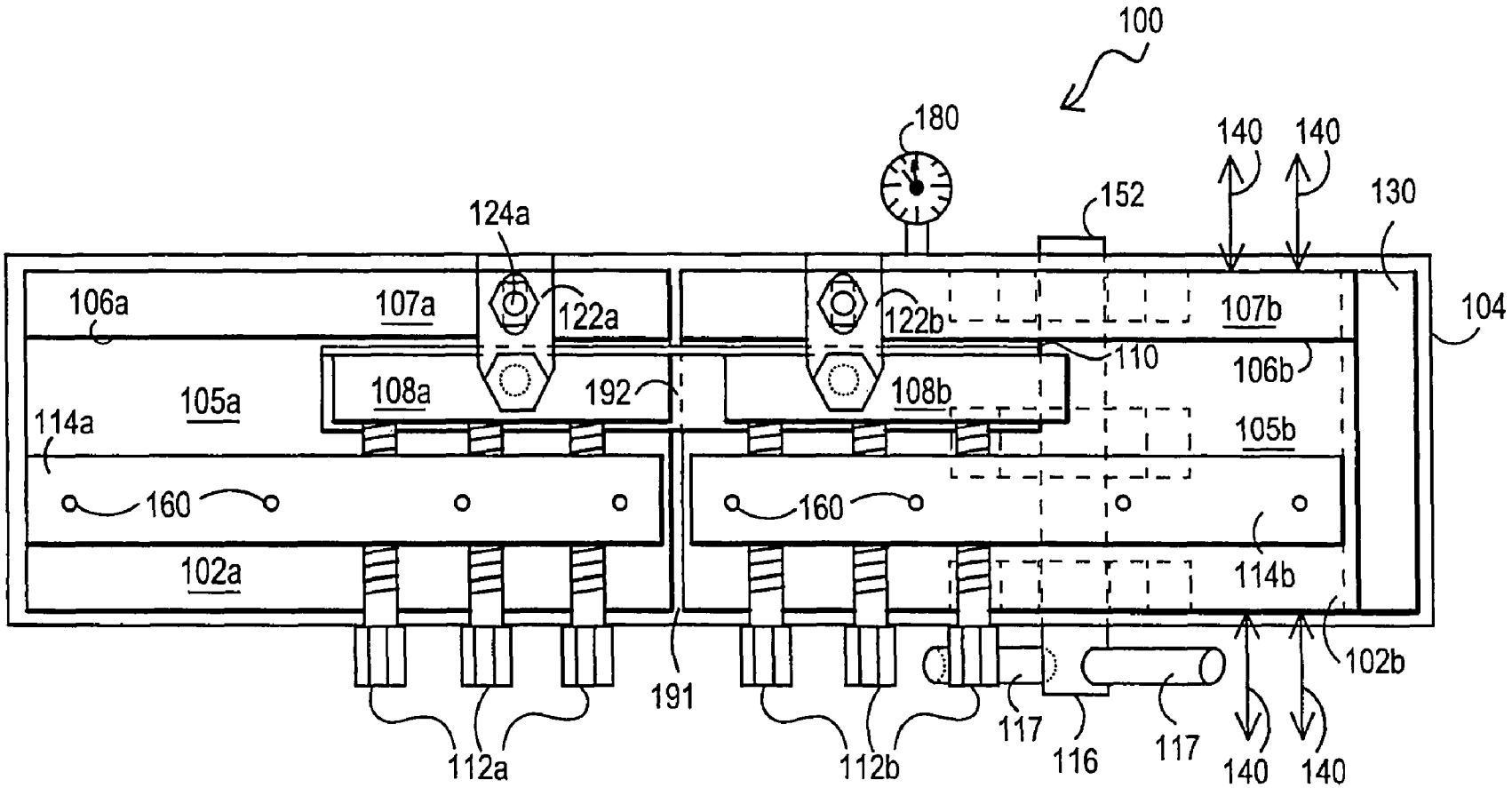
FIG. 2 is a top view of a die-forming apparatus configured according to one exemplary embodiment of the disclosed apparatus and methods.
Figure 3:
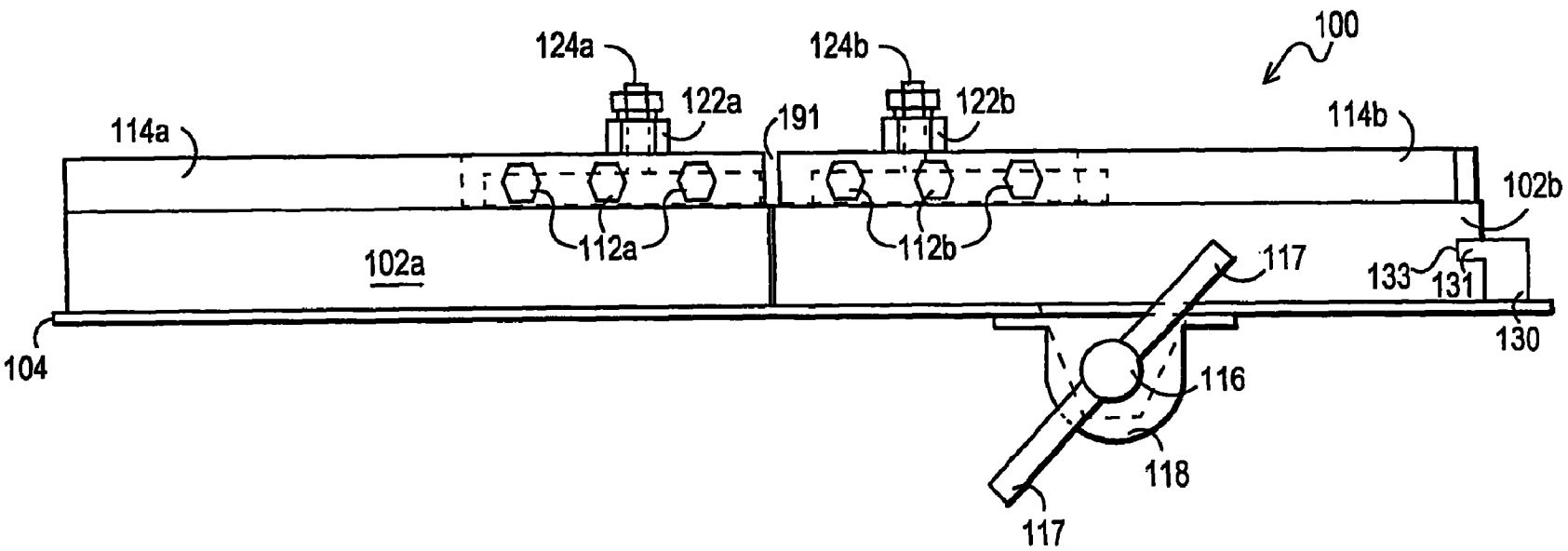
FIG. 3 is a frontal view of a die-forming apparatus configured according to one exemplary embodiment of the disclosed apparatus and methods.
Figure 4:
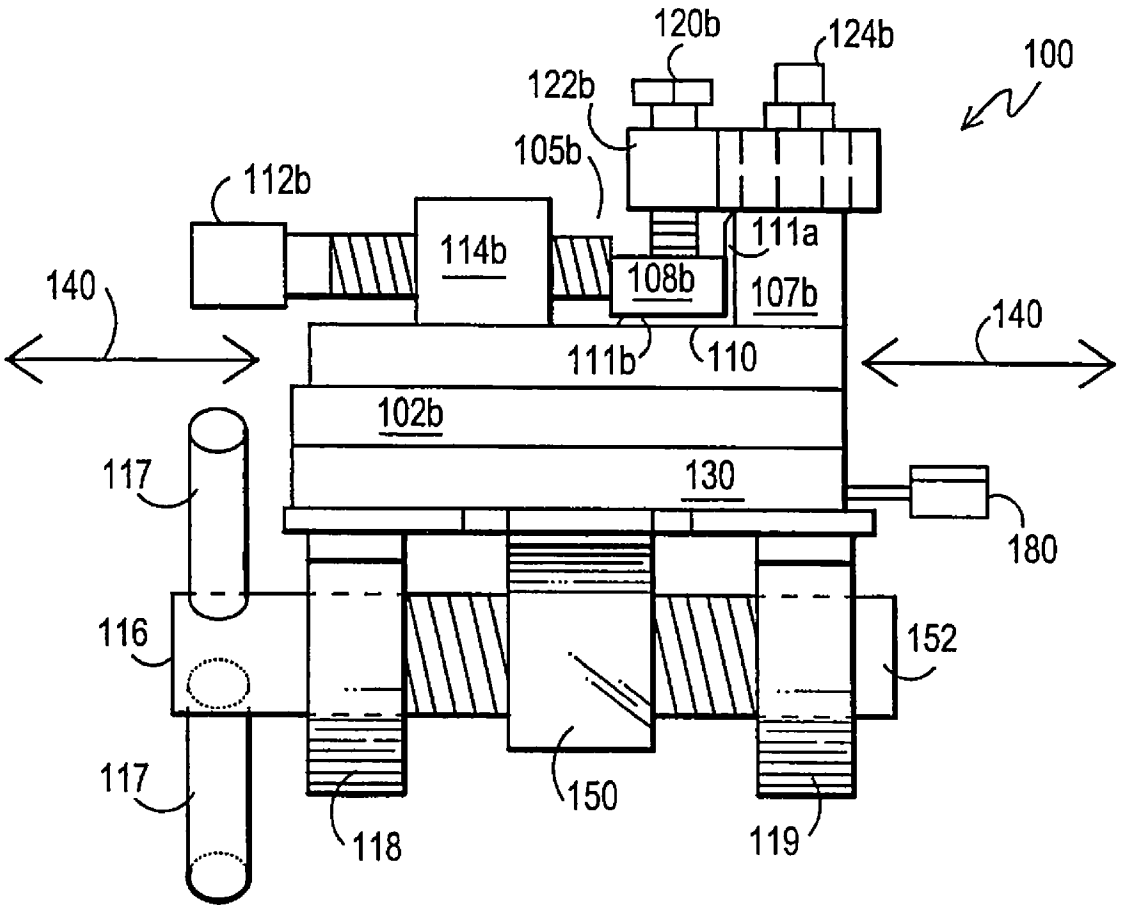
FIG. 4 is a left side view of a die-forming apparatus configured according to one exemplary embodiment of the disclosed apparatus and methods.
Figure 5:
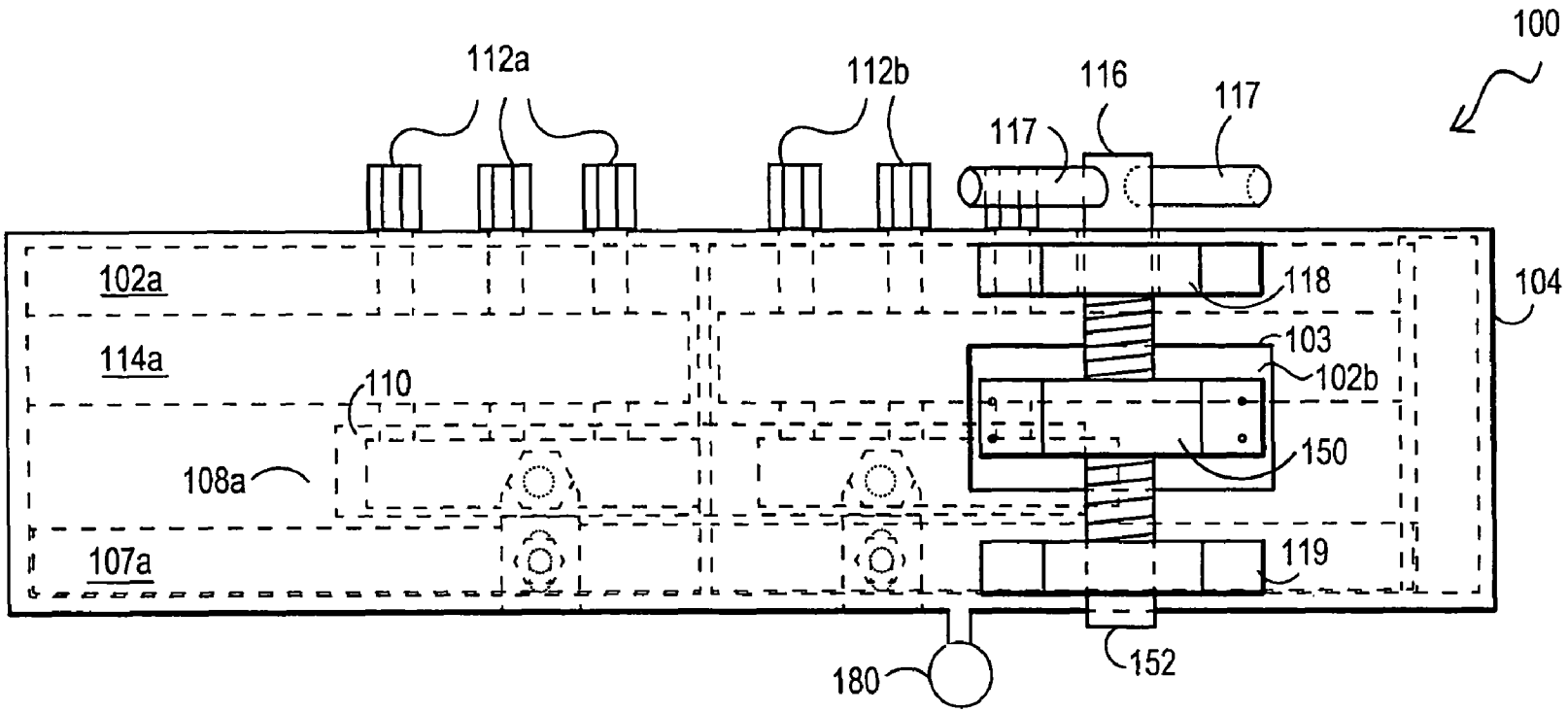
FIG. 5 is a bottom view of a die-forming apparatus configured according to one exemplary embodiment of the disclosed apparatus and methods.
Figure 7A:
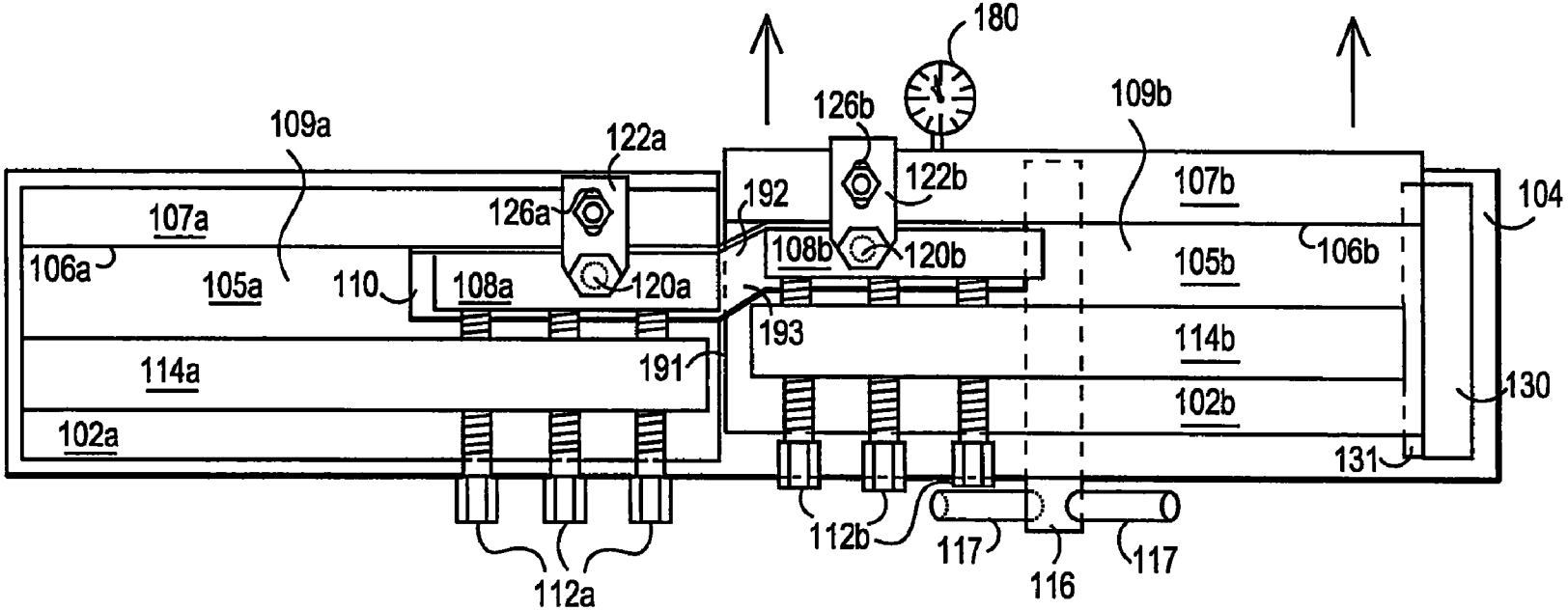
FIG. 7A is a top view of a die-forming apparatus configured according to one exemplary embodiment of the disclosed apparatus and methods.

FIG. 7A shows a top view of die-forming apparatus 100 after movable second die platform 102*b* has been moved in a rearward direction as shown by the arrows to a second position relative to first die platform 102*a* from the first position relative to first die platform 102*a* that is shown in FIG. 2. As may be seen in FIG. 7, a joggle 193 has been induced into workpiece 110 by this movement of movable second die platform 102*b*. It will be understood that a joggle may alternatively be induced into workpiece 110 by moving movable second die platform 102*b* in an opposite (e.g., forward direction) to a second position relative to first die platform 102*a* from the first position relative to first die platform 102*a*.

Figure 7B:
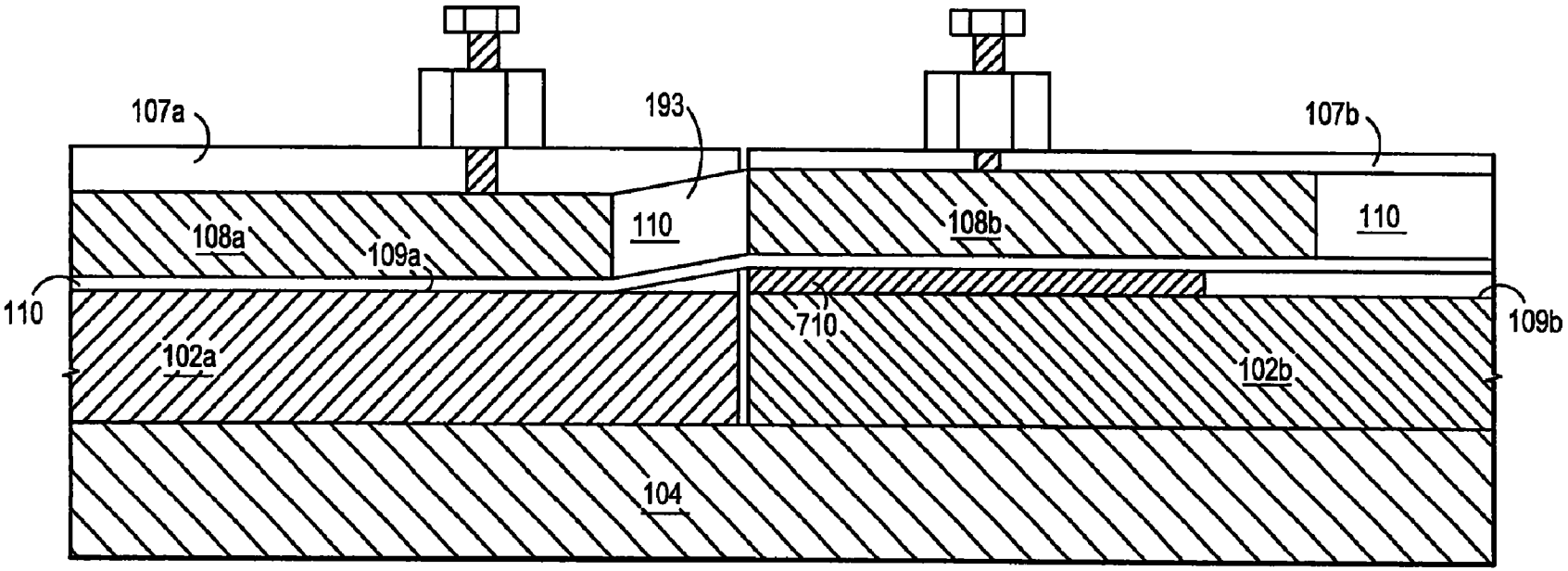
FIG. 7B is a partial cross sectional frontal view of a die-forming apparatus configured according to one exemplary embodiment of the disclosed apparatus and methods.
Figure 7C:
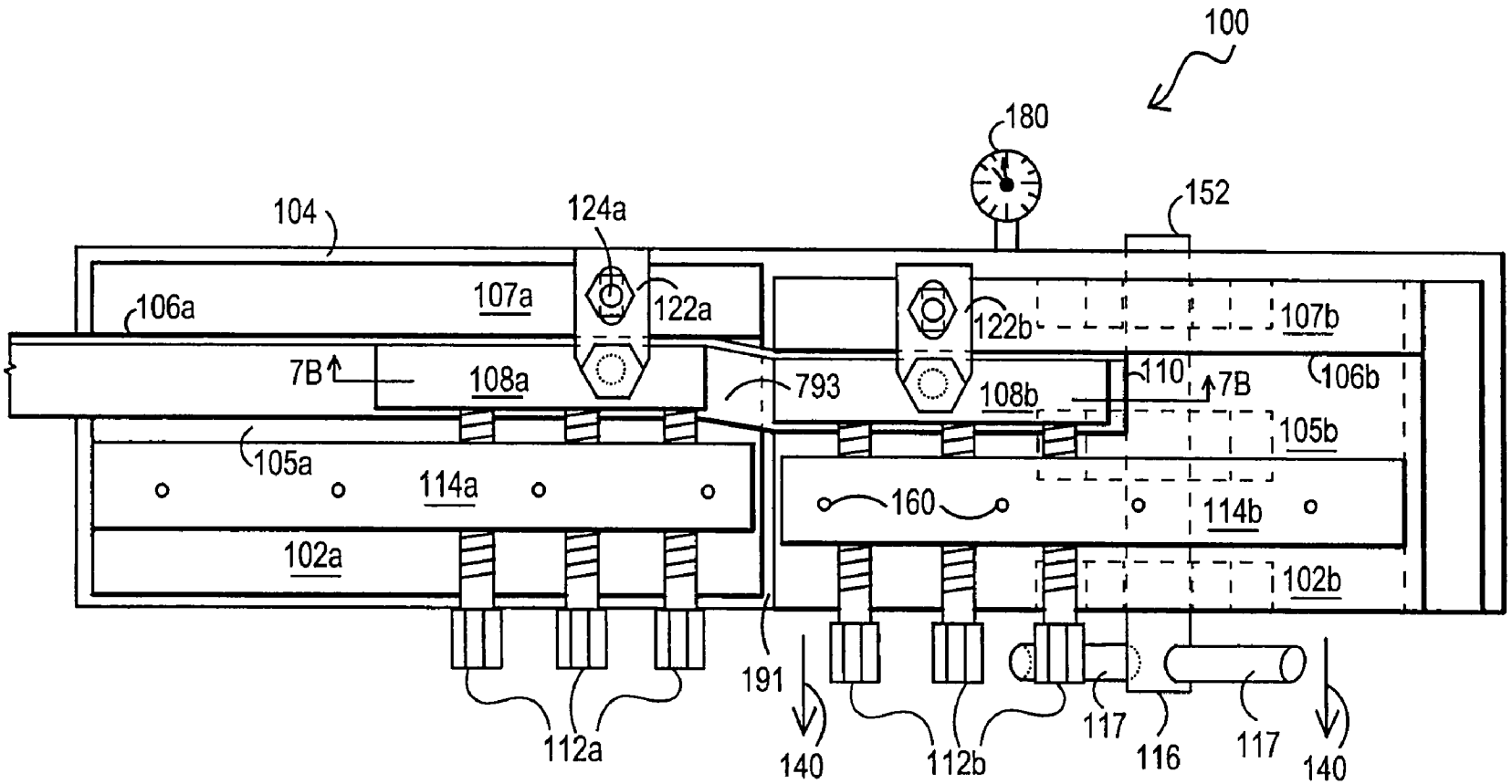
FIG. 7C is a top view of a die-forming apparatus configured according to one exemplary embodiment of the disclosed apparatus and methods.
Figure 7E:
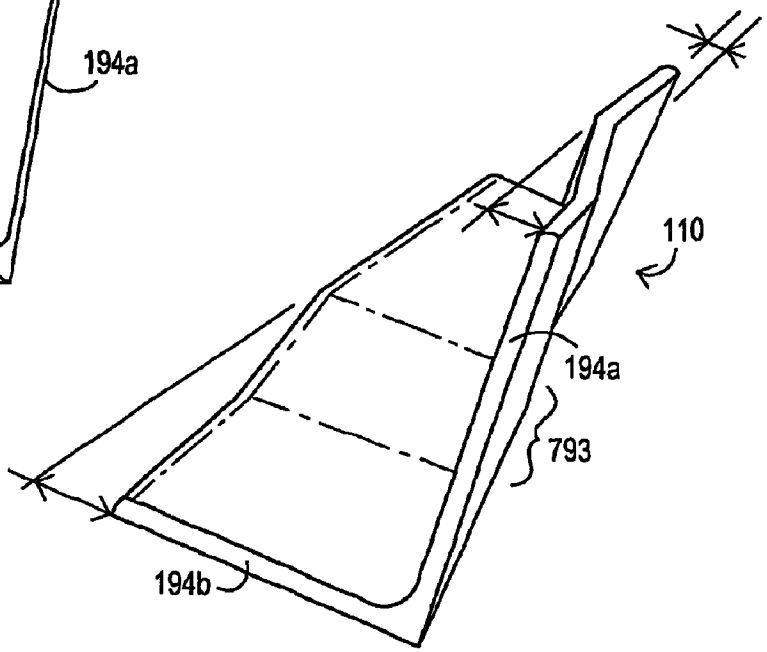
FIG. 7E is a perspective view of a multiplanar workpiece having a multiple joggle which has been induced according to one exemplary embodiment of the disclosed apparatus and methods.
Figure 7D:
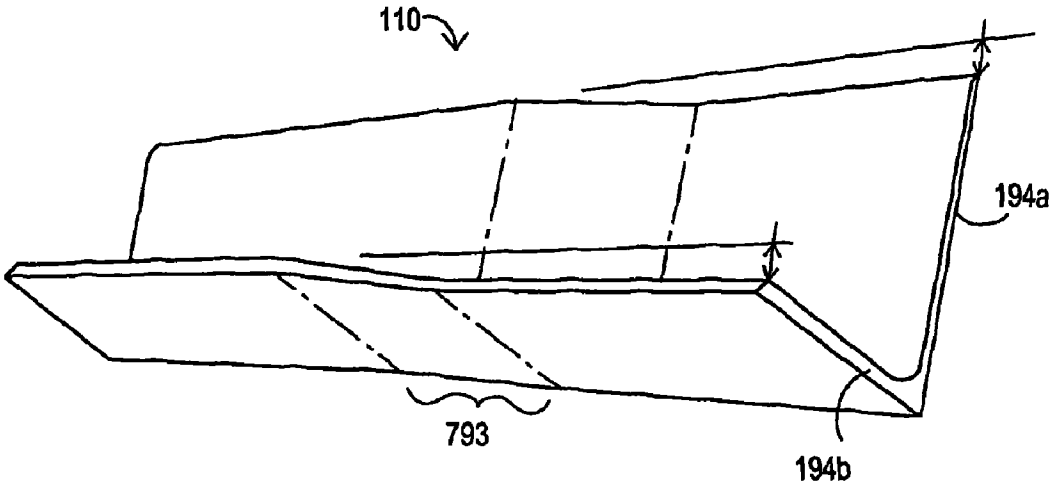
FIG. 7D is a perspective view of a multiplanar workpiece having a multiple joggle which has been induced according to one exemplary embodiment of the disclosed apparatus and methods.
Figure 8:
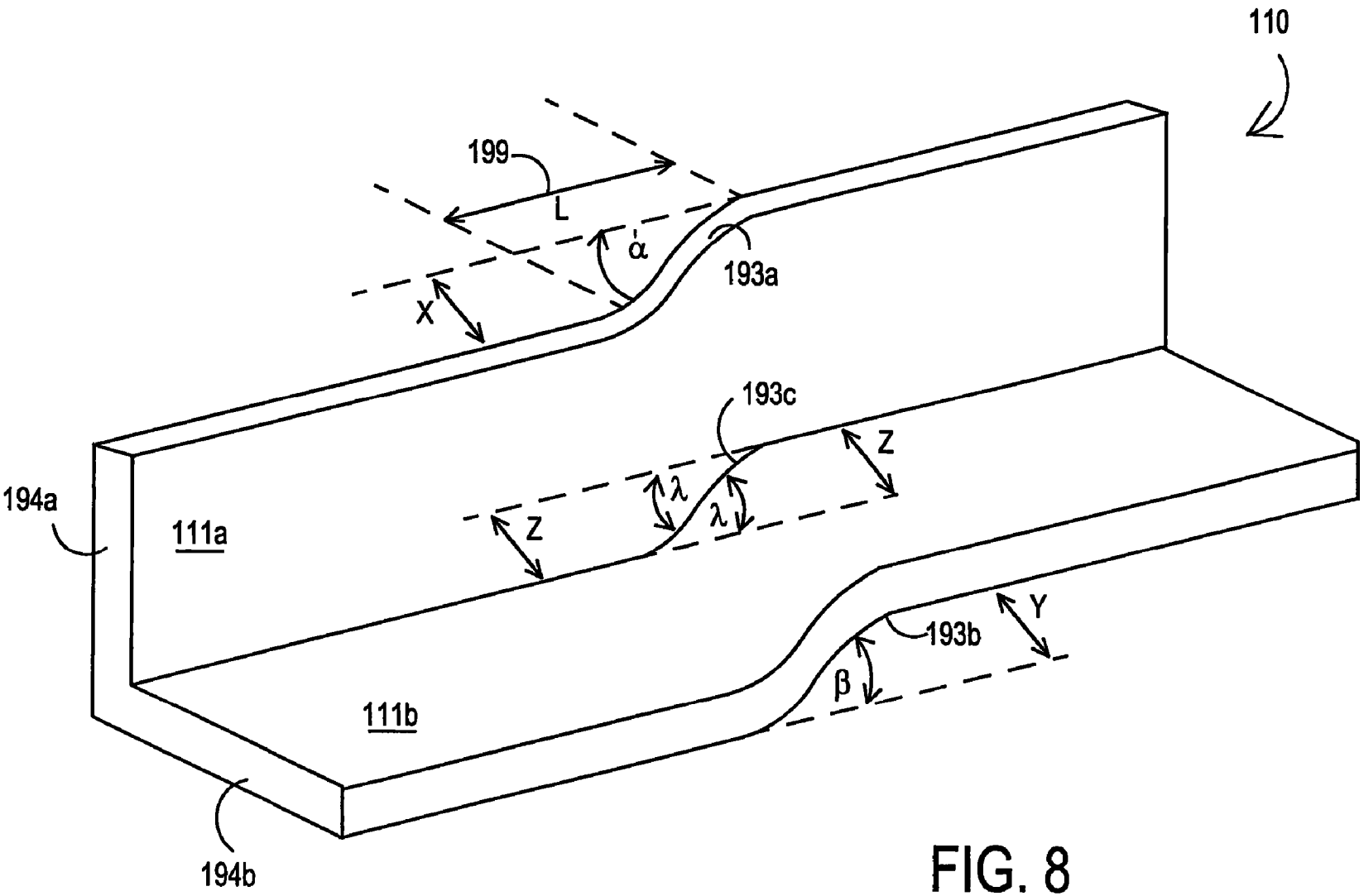
FIG. 8 is a perspective view of a multiplanar workpiece having a joggle which has been induced according to one exemplary embodiment of the disclosed apparatus and methods.

FIG. 8 illustrates a multiplanar workpiece 110 in which a joggle 193 has been induced using die-forming apparatus 100 of FIGS. 1-7A. As shown in FIG. 8, joggle 193 includes joggle portion 193*a* created by displacement perpendicular to the plane of first perpendicularly-oriented side member section 111*a* and joggle portion 193*b* created by displacement parallel to the plane of second perpendicularly-oriented side member section 111*b*. As previously described, transition of joggle 193 has a length (L) 199. In the illustrated embodiment, first perpendicularly-oriented side member section 111*a* has been displaced by a distance of "X" in a direction perpendicular to the plane of first perpendicularly-oriented side member section 111*a* to create a joggle displacement angle $\acute{\alpha}$, and second perpendicularly-oriented side member section 111*b* has been displaced by a distance of "Y" in a direction parallel to the plane of second perpendicularly-oriented side member section 111*b* to create a joggle displacement angle $\beta$. As further shown, a joggle portion 193*c* having a displacement distance of "Z" and forming joggle displacement angle $\lambda$ is also created at the intersection of side member sections 194*a* and 194*b*. In this exemplary embodiment, joggle 193 may be induced using die-forming apparatus 100 in a manner so that each of joggle displacement distances X, Y and Z are substantially equal to each other, and so that each of joggle displacement angles $\acute{\alpha}$, $\beta$ and $\lambda$ are substantially equal to each other. In one exemplary embodiment, joggle displacement angles $\acute{\alpha}$, $\beta$ and $\gamma$ of from about 3 degrees to about 45 degrees are possible, however, joggle displacement angles of less than about 3 degrees and greater than about 45 degrees are possible in other embodiments.

FIGS. 7B and 7C illustrate optional steps that may be undertaken to form a multiple joggle after formation of a single joggle in FIG. 7A. In this exemplary embodiment, formation of second joggle is undertaken to produce a double joggle. As shown in the cutaway view of FIG. 7B, workpiece 110 has been reoriented within channel-shaped working areas 105*a* and 105*b* so that the outwardly-displaced end of joggle 193 of FIG. 7A (e.g., of joggle portion 193*a* of FIG. 8) faces downward and is in contact with working surface 109*a* and with a spacer 710 positioned between workpiece 110 and working surface 109*b*. In this exemplary embodiment, spacer 710 is a flat piece of metal having a thickness that is substantially equal to a displacement distance of joggle 193. Workpiece dies 108*a* and 108*b* are then placed into position on top of workpiece 110 as before, prior to tightening down the die securing devices to secure the die and workpiece in place.

FIG. 7C shows a top view of die-forming apparatus 100 after movable second die platform 102*b* has been moved in a forward direction as shown by the arrows to a second position relative to first die platform 102*a* from the first position relative to first die platform 102*a* to create a double joggle 793 into workpiece 110 by this movement of movable second die platform 102*b*. Double joggle 793 is further shown in perspective view in FIGS. 7D and 7E. In this exemplary embodiment, movable second die platform 102*b* has been moved in a forward direction so as to induce a double joggle where both side member sections 194*a* and 194*b* are joggled outwardly so as to minimize tendency of workpiece 110 to buckle during formation of the second joggle operation.

Figure 9A:
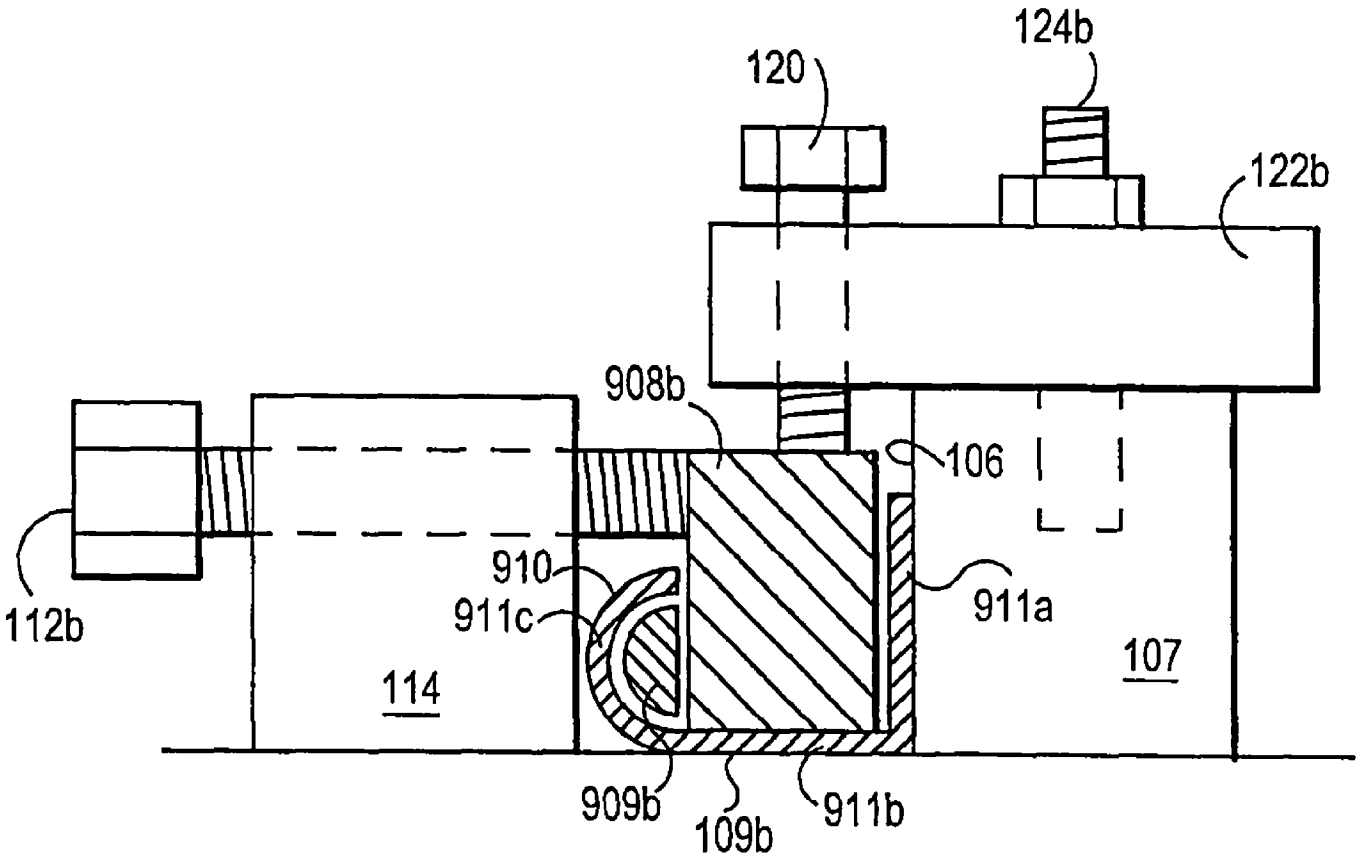
FIG. 9A is a left side view of a die-forming apparatus configured according to one exemplary embodiment of the disclosed apparatus and methods.

It will be understood that multi-planar bendable workpiece 100 illustrated in FIGS. 1-8 represents only one exemplary configuration of multi-planar shape workpiece that may be die formed using the disclosed apparatus and methods. In this regard, FIGS. 9A and 9B illustrate one exemplary embodiment in which unbent multi-planar elongated bendable workpiece 910 having a channel-shaped configuration is positioned within first and second channel-shaped working areas 105*a* and 105*b* so that the longitudinal axis of workpiece 910 is aligned in substantially parallel relationship with the longitudinal axis of each of working areas 105*a* and 105*b*, and so that the outside surface of a first side member section 911*a* of workpiece 910 is in contact with side working surfaces 106*a* and 106*b*, and so that the outside surface of a second side member section 911*b* of workpiece 910 is in contact with base working surfaces 109*a* and 109*b* in a manner similar to that as previously described for angle iron workpiece 110.

Figure 9B:
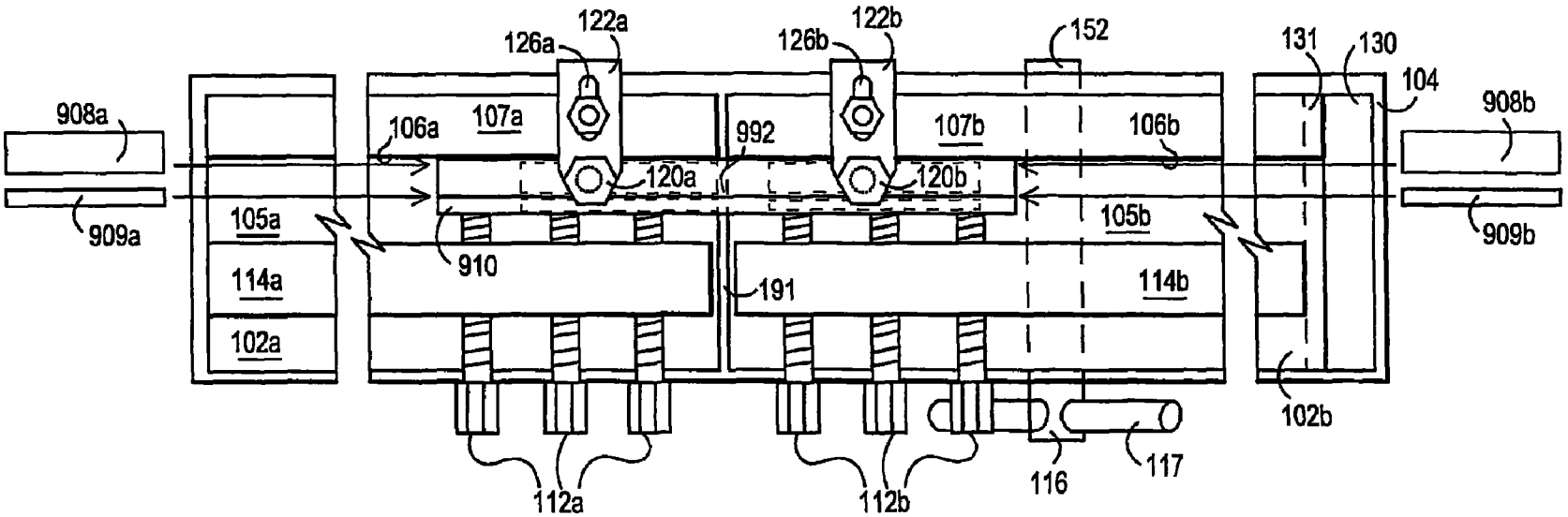
FIG. 9B is a top view of a die-forming apparatus configured according to one exemplary embodiment of the disclosed apparatus and methods.
Figure 10A:
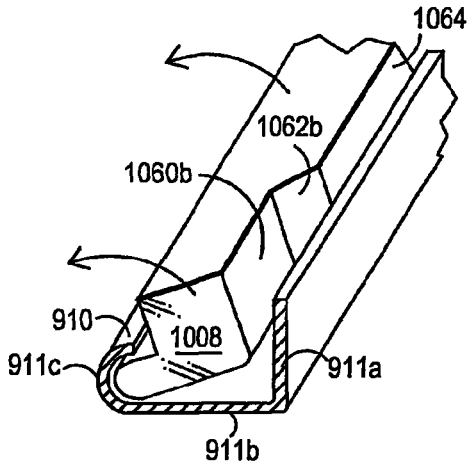
FIG. 10A is a left side perspective view of a die-forming apparatus configured according to one exemplary embodiment of the disclosed apparatus and methods.

FIG. 9B shows workpiece die 908*a* and 908*b* as they may be inserted as shown by the arrows into the ends of channel-shaped multi-planar workpiece 910, which itself is in turn disposed within first and second working areas 105*a* and 105*b* prior to die-forming operations. Side insertion of workpiece die may be employed, for example, when the opening on the upper surface of a multi-planar workpiece is not large enough to allow insertion and removal of workpiece die from the top. Also shown in FIG. 9B are separate die shim pieces 909*a* and 909*b* that may be placed between each respective workpiece die 908 and the inside surface of a third side member section 911*c* of workpiece 910. In this regard, each of die shim pieces 909 may be so positioned in order to create a substantially tight and secure fit for its respective workpiece die 908 within channel-shaped workpiece 910 during die-forming operations. Die shim pieces 909*a* and 909*b* may then be removed out of each respective opposing ends of channel-shaped workpiece 910 following die-forming operations, thus freeing workpiece die 908*a* and 908*b* for removal from opposing ends of channel-shaped workpiece 910. It will be understood that a single-piece workpiece die may alternatively be configured in another embodiment for use without shims for a multi-planar shape workpiece, e.g., as illustrated by single-piece workpiece die 1008 in FIG. 10A. Such a configuration may be employed, for example, where dimensions of a channel-shaped workpiece (or workpiece of another shape) allows the single piece workpiece die to be removed from either end of the workpiece and/or by manipulating the single piece die through an opening in one longitudinal side of the workpiece as shown in FIG. 10A. As shown in FIG. 10A, outer dimensions of workpiece die 1008 may be configured complementary to mating inner dimensions of workpiece 910 (e.g. by providing substantially complementary-dimensioned radius on each corner of workpiece 910 that contacts and mates with a respective internal corner of workpiece 910).

Positions of workpiece die 908*a* and 908*b* (together with respective die shims 909*a* and 909*b*) within workpiece 910 during die forming operations are shown in dashed outline in FIG. 9B. As shown, each of die shims 909 may be positioned so as to be substantially aligned with its respective workpiece die 908 within channel-shaped workpiece 910, with a gap 992 left between die 908*a* and 908*b* and die shims 909*a* and 909*b* that corresponds to the location of a joggle to be formed in workpiece 910. As with the embodiment of FIGS. 1-7, gap 992 may or may not coincide or be substantially aligned with gap 191 between stationary first die platform 102*a* and movable second die platform 102*b*. Furthermore, joggle transition length L may be set by varying the width of gap 992 in a manner as previously described in relation to FIG. 7A.

Figure 10B:
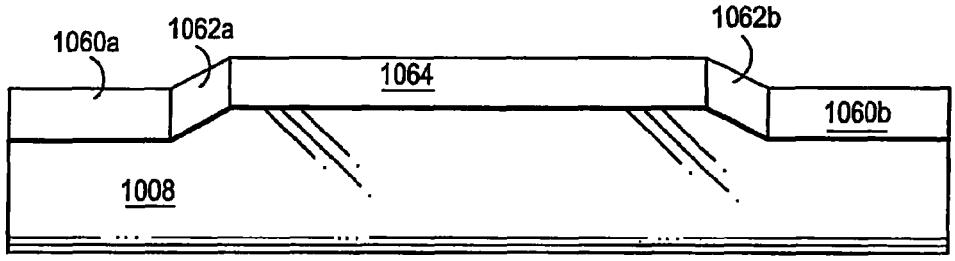
FIG. 10B is a perspective view of a workpiece die according to one exemplary embodiment of the disclosed apparatus and methods.
Figure 10C:
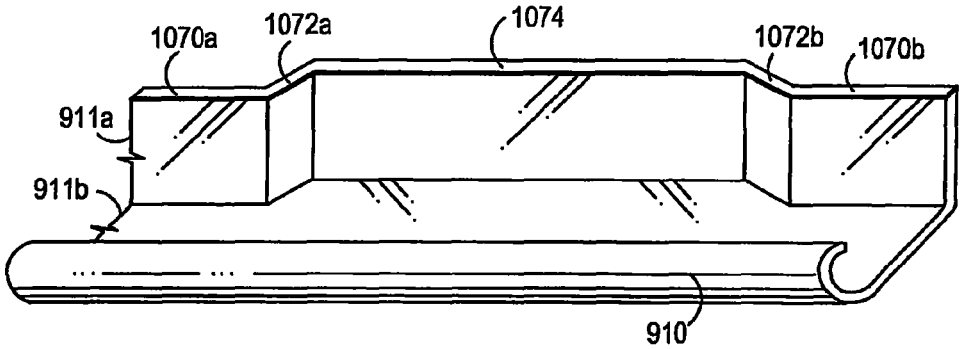
FIG. 10C is a perspective view of a multiplanar workpiece having a joggled profile according to one exemplary embodiment of the disclosed apparatus and methods.

FIGS. 10A-10E illustrate how an outer surface of a single workpiece die 1008 may be optionally configured with a shaped profile that may be employed to create a joggle/s in a single side member section 911*a* of workpiece 910. FIG. 10C shows two joggle profile/s including joggle sections 1072*a* and 1072*b* that may be created in workpiece 910 using a single workpiece die 1008. However, it will be understood that more than one workpiece die may be configured with a shaped profile and employed together, e.g., in a similar manner to the embodiment of FIGS. 9A and 9B. In the illustrated embodiment of FIGS. 10A-10E, the opening on the upper side of multi-planar workpiece 910 is large enough to allow workpiece die 1008 to be removed from workpiece 910 after die-forming operations by outward rotation as shown by the arrows in FIG. 10A.

In this exemplary embodiment, workpiece die 1008 is shown in FIGS. 10A and 10B as having a profiled surface that includes profile sections 1060, 1062 and 1064. The profiled surface of workpiece die 1008 may be biased against inside of side member section 911 of workpiece 910 to form a complementary joggled profile in only one side member section 911*a* as shown in FIGS. 10A and 10C. In this exemplary embodiment, sections 1070*a* and 1070*b* of side member section 911*a* correspond to profile sections 1060*a* and 1060*b* of workpiece die 1008, joggle sections 1072*a* and 1072*b* of side member section 911*a* correspond to angular profile sections 1062*a* and 1062*b* of workpiece die 1008, and section 1074 of side member section 911*a* corresponds to raised profile section 1064 of workpiece die 1008 that is raised from surfaces 1060*a* and 1060*b* by virtue of angular surfaces 1062*a* and 1062*b*.

It will be understood that the illustrated shaped profile of workpiece die 1008 of the embodiment of FIGS. 10A-10E is exemplary only and that other optional shaped profiles may be employed, including shaped profiles configured for use in forming one joggle or more than two joggles into a single side of a workpiece. In one exemplary embodiment, thickness of side member section 911*a* may be about 0.03 inches to about 0.125 inches (although greater or lesser thicknesses are possible) and joggle sections 1072*a* and 1072*b* may have a displacement distance each about 0.03 to about 1.0 inches in depth, although displacement distances less than about 0.03 inches or more than 1.0 inches are also possible.

Figure 10D:
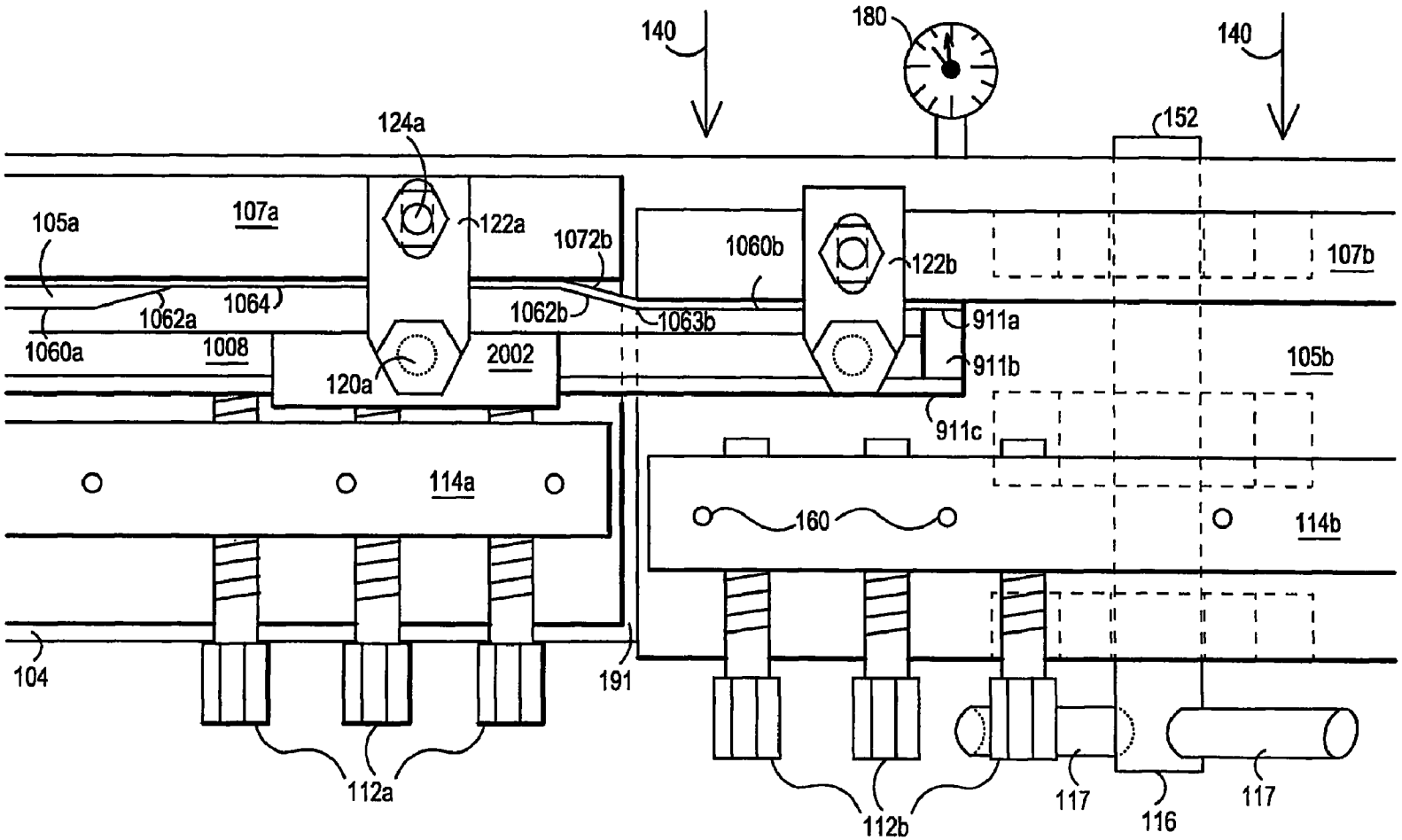
FIG. 10D is a top view of a die-forming apparatus configured according to one exemplary embodiment of the disclosed apparatus and methods.
Figure 10E:
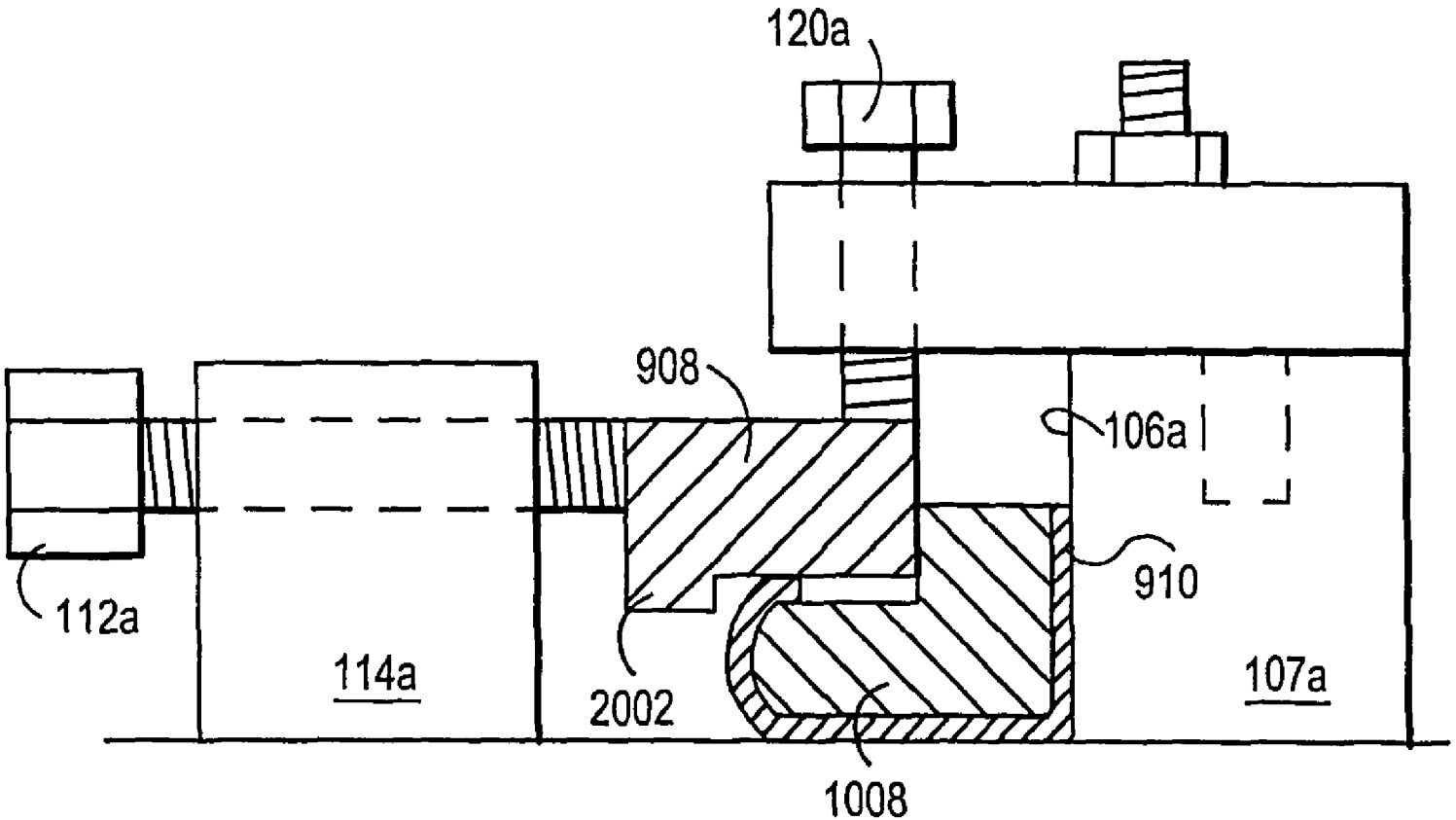
FIG. 10E is a partial cross-sectional side view of a die-forming apparatus configured according to one exemplary embodiment of the disclosed apparatus and methods.

FIGS. 10D and 10E illustrate one exemplary embodiment in which two joggle profiles may be formed in single side member section 911*a* of workpiece 910 (e.g., two joggle profiles may be formed at positions adjacent the opposite ends of workpiece 910) by the shaped profile of single workpiece die 1008. In this exemplary embodiment, workpiece die 1008 is positioned within bendable workpiece 910 as shown, e.g., by sliding workpiece die 1008 into position from one of the open and unbent ends of workpiece 910, or by insertion and rotation from the top where dimensions of workpiece 910 permit. Although illustrated workpiece die 1008 is shown configured with two angular profile sections 1062*a* and 1062*b*, it will be understood that a workpiece die may be configured in other embodiments with a single profile section (e.g., single angular profile section), or with a greater number of profile sections than is illustrated workpiece die 1008.

Prior to beginning die-forming operations, bendable workpiece 910 with workpiece die 1008 is first positioned within first and second channel-shaped working areas 105*a* and 105*b* so that the longitudinal axis of workpiece 910 is aligned in substantially parallel relationship with the longitudinal axis of each of working areas 105*a* and 105*b*, and so that the outside surface of a first side member section 911*a* of workpiece 910 is in contact with side working surfaces 106*a* and 106*b*, and so that the outside surface of a second side member section 911*b* of workpiece 910 is in contact with base working surfaces 109*a* and 109*b* in a manner similar to that as previously described for angle iron workpiece 110.

Initially, movable second die platform 102*b* is place in a first position so that first and second channel-shaped working areas 105*a* and 105*b* are in a substantially aligned position to accept workpiece die 1008, and workpiece die 1008 is positioned so that one of angular profile sections 1062*a* and 1062*b* of workpiece die 1008 is positioned adjacent gap 191 between stationary first die platform 102*a* and movable second die platform 102*b*. In the exemplary illustration of FIG. 10D, angular profile section 1062*b* is shown first positioned opposite gap 191, although it is alternatively possible that the die-forming process may begin with angular profile section 1062*a* first positioned opposite gap 191. As shown, angular profile 1062*b* is positioned so that the outboard corner 1063*b* of profile 1062*b* is substantially aligned with the leftmost side of elongated working member 107*b*.

Referring to FIGS. 10D and 10E, a spacer block 2002 is placed in position over stationary first die platform 102*a* between corresponding surfaces of workpiece die 1008 and each of die securing devices 112*a* and die securing device 120*a* so that workpiece die 1008 may be turn held operably in place within workpiece 910 on stationary first die platform 102*a* as shown. Die securing device 120*a* is extended to contact top of spacer block 2002, and die securing devices 112*a* are extended to bias spacer block 2002 toward side working surface 106*a* with workpiece die 1008 and a part of a first side member section of workpiece 110 positioned therebetween in a secure vise-like manner as shown.

Figure 10F:
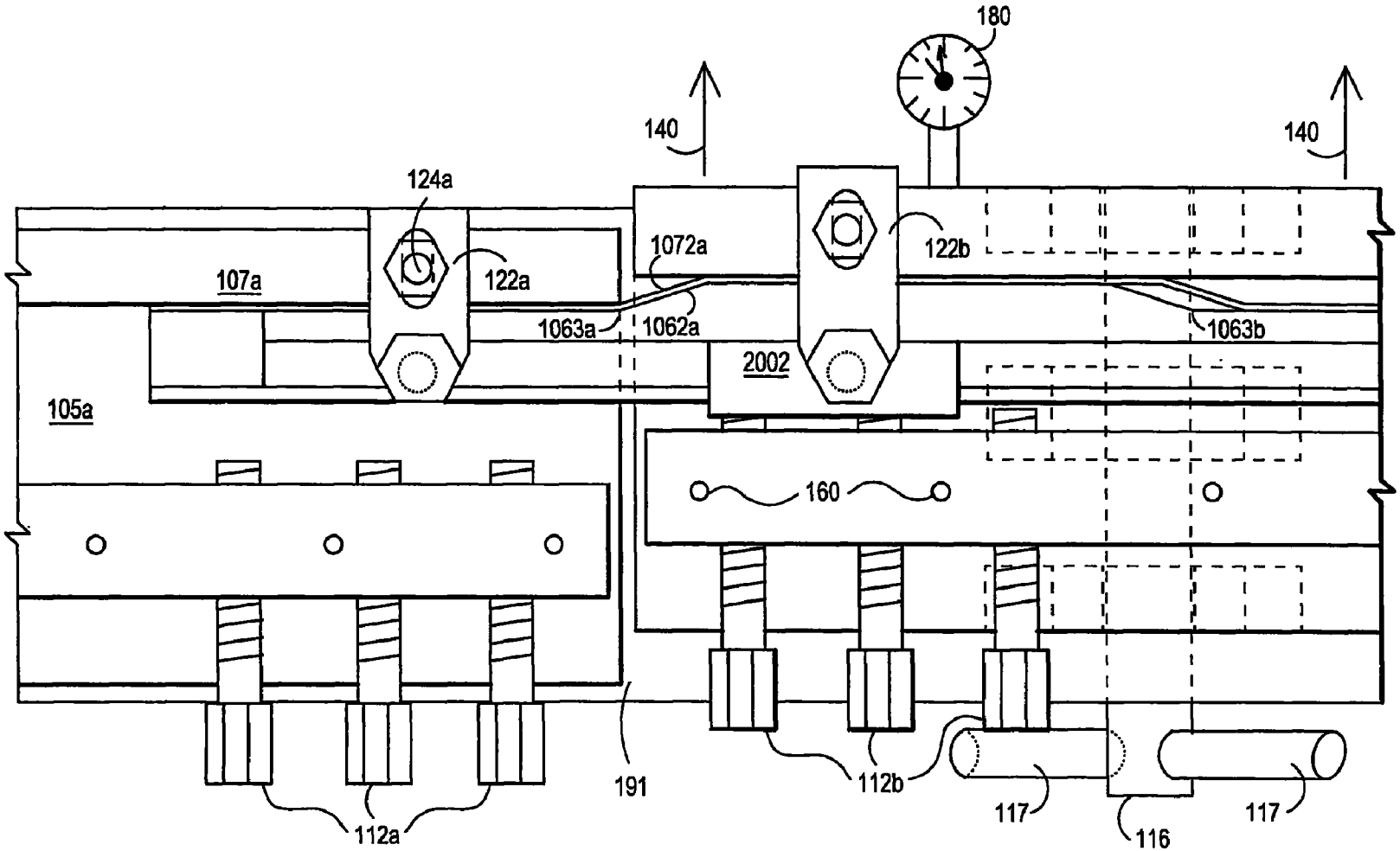
FIG. 10F is a top view of a die-forming apparatus configured according to one exemplary embodiment of the disclosed apparatus and methods.

Next, movable second die platform 102*b* is moved from its first position in a forward direction as shown by the arrows in FIG. 10D to a second position relative to first die platform 102*a* to induce a joggle in a first end of single side member section 911*a* of workpiece 910 as shown. Die securing devices 102*a* and 112*a* are then retracted and movable second die platform 102*b* returned to its first position so that workpiece 910, workpiece die 1008 and spacer block 2002 may be repositioned within first and second channel-shaped working areas 105*a* and 105*b* in a position as shown in FIG. 10F. Similar methodology may then be repeated by moving movable second die platform 102*b* in a rearward direction as shown by the arrows in FIG. 10F to induce a joggle in a second and opposite end of single side member section 911*a* of workpiece 910 as shown in FIG. 10F. As shown, angular profile 1062*a* is positioned so that the outboard corner 1063*a* of profile 1062*a* is substantially aligned with the rightmost side of elongated working member 107*a*.

Figure 11A:
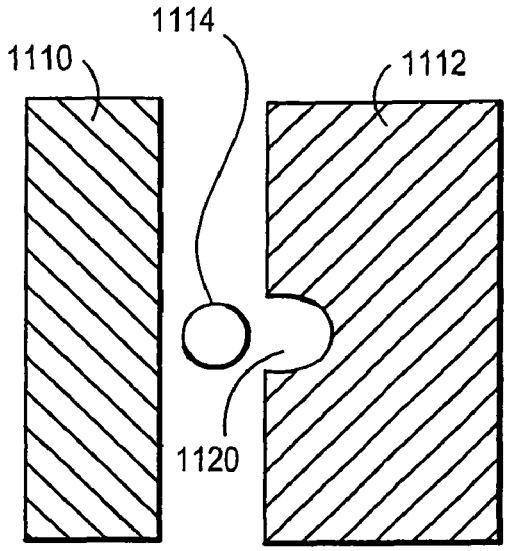
FIG. 11A is a side view of a bendable workpiece and a pair of die blocks according to one exemplary embodiment of the disclosed apparatus and methods.
Figure 11B:
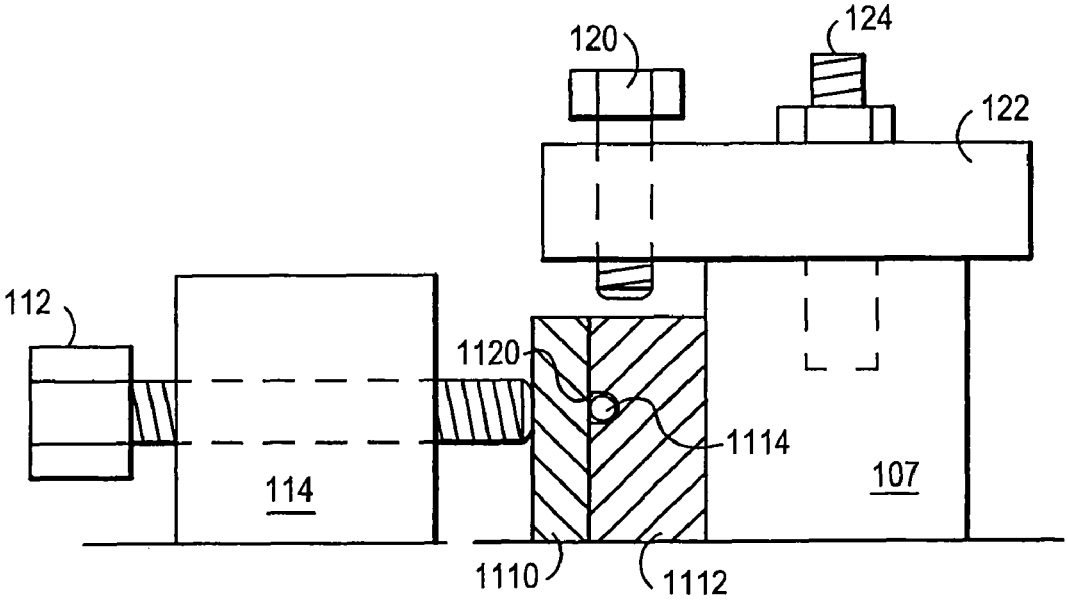
FIG. 11B is a partial cross-sectional side view of a die-forming apparatus configured according to one exemplary embodiment of the disclosed apparatus and methods.
Figure 11C:
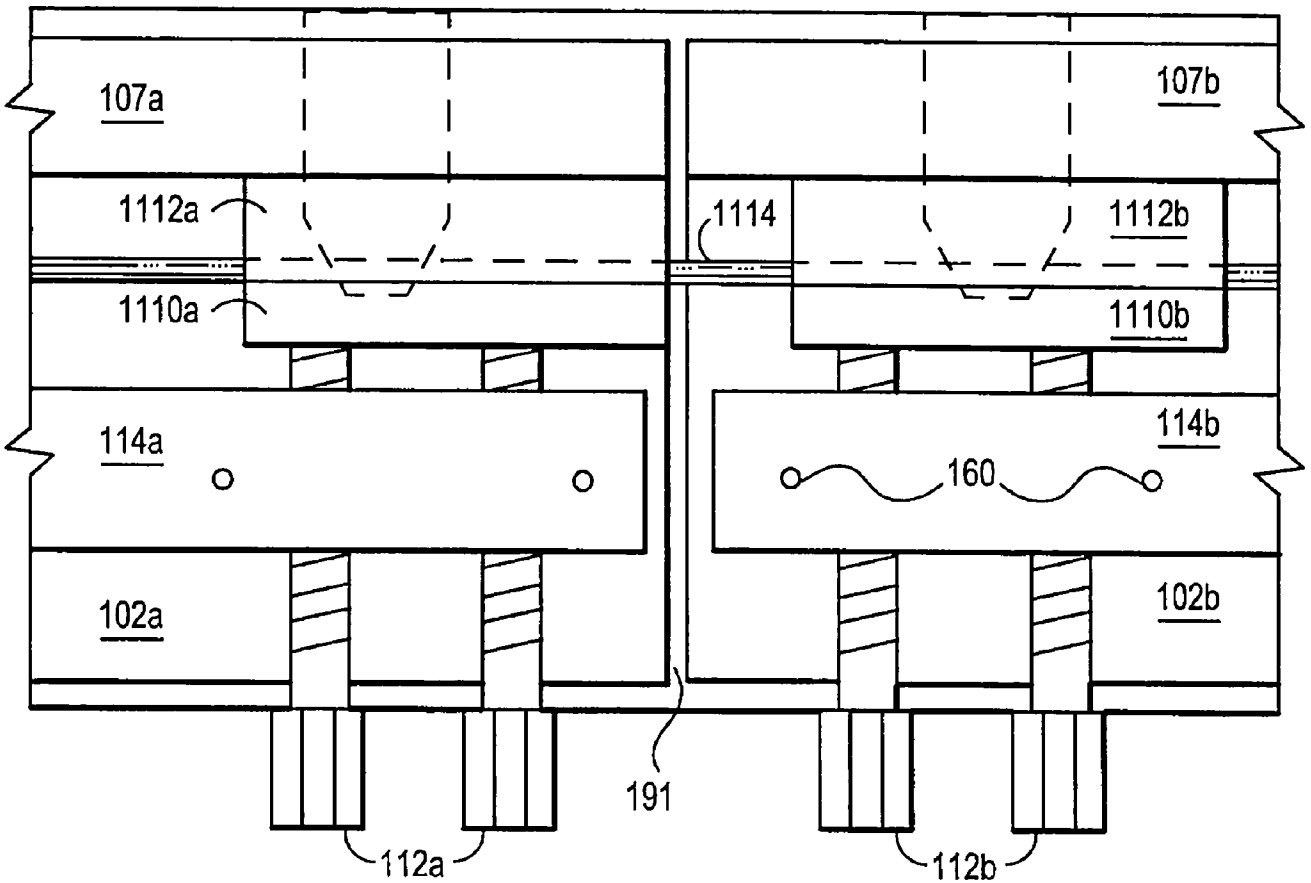
FIG. 11C is a top view of a die-forming apparatus configured according to one exemplary embodiment of the disclosed apparatus and methods.

FIGS. 11A-11E show another exemplary embodiment of the disclosed systems and methods as it may be implemented to form a joggle in a suspended bendable workpiece. Such a suspended work piece may be in the form of an elongated piece of solid tubing having a cylindrical cross section, square cross section, etc. and may be of any suitable bendable material (e.g., metal workpiece, aluminum or steel extrusion, plastic or Teflon® laminate, etc.). As shown in FIGS. 11A and 11B, an elongated solid cylindrical workpiece (rod) 1114 may be sandwiched in one exemplary embodiment between a first pair of die blocks 1110*a* and 1112*a*, and a second pair of die blocks 1110*b* and 1112*b*, and then suspended in position within first and second channel-shaped working areas 105*a* and 105*b* of a die-forming apparatus 100 as shown in FIG. 11C so that the longitudinal axis of workpiece 1114 is aligned in substantially parallel relationship with the longitudinal axis of each of working areas 105*a* and 105*b*.

FIG. 11B illustrates how a first internal recess 1120 may be defined within die block 1112 that has internal dimensions complementary to external dimensions of workpiece 1114 so that workpiece 1114 may be inserted and received tightly within recess 1120. In this regard, workpiece 1114 may be, for example, a cylindrical steel rod having an external diameter of about 0.250 inches. As so configured, die blocks 1112 and 1110 may be used to contact and secure workpiece 1114 therebetween when they are brought together around workpiece 1114 in a manner as shown in FIG. 11B. In one exemplary embodiment, recess 1120 may be optionally dimensioned to have a depth slightly less than the diameter of workpiece 1114, e.g., to have a depth of about 0.249" inches so that recess 1120 is large enough to receive all but a portion (e.g., all but about 0.001") of the diameter of workpiece 1114 so that it may be substantially immovably secured between recess 1120 and contacting die block 1110.

In the exemplary embodiment of FIG. 11C, elongated cylindrical workpiece 1114 is shown suspended such that the longitudinal axis of workpiece 1114 is aligned in substantially parallel relationship with the longitudinal axis of each of working areas 105*a* and 105*b*, and so that an outer surface of die block 1112*a* is in contact with side working surface 106*a*, an outer surface of die block 1112*b* is in contact with side working surface 106*b*, an outer surface of die block 1110*a* is in contact with extended die securing devices 112*a*, and an outer surface of die block 1110*b* is in contact with extended die securing devices 112*b*.

Figure 11D:
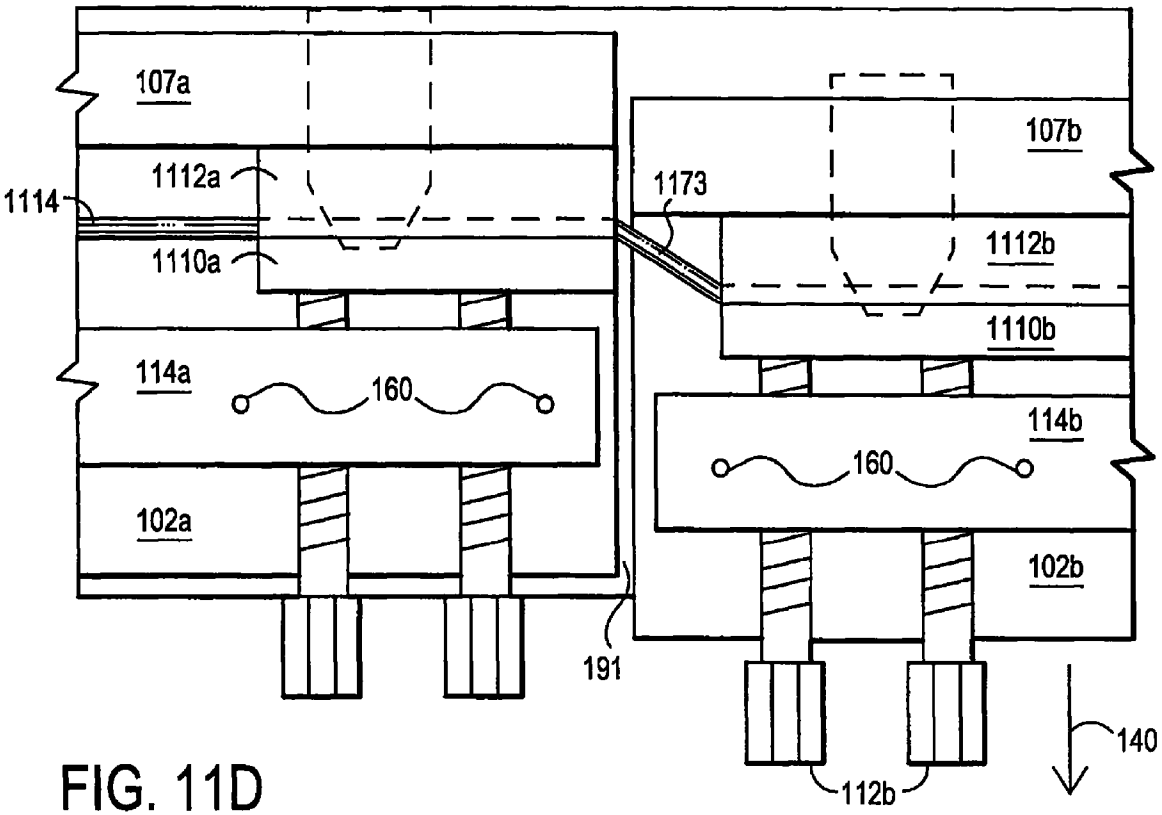
FIG. 11D is a top view of a die-forming apparatus configured according to one exemplary embodiment of the disclosed apparatus and methods.
Figure 11E:
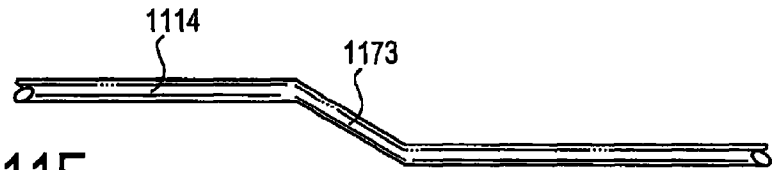
FIG. 11E is a perspective view of a multiplanar workpiece having a joggle which has been induced according to one exemplary embodiment of the disclosed apparatus and methods.

FIG. 11D shows how movable second die platform 102*b* may be moved from its first substantially aligned position with first die platform 102*a* in a forward direction as shown by the arrows in FIG. 11D to a second position relative to first die platform 102*a* to induce a joggle 1173 in workpiece 1114 as shown. Die securing devices 112*a* and 112*b* may then workpiece 1114 removed as shown in FIG. 11E.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and methods may be utilized in various combinations and/or independently. Thus the invention is not limited to only those combinations shown herein, but rather may include other combinations.

What is claimed is:

1. A die-forming apparatus, comprising:

a first working area provided with a first working surface, said first working area configured to receive a first workpiece die and a first portion of a bendable workpiece having first and second opposing sides between said first workpiece die and said first working surface of said first working area such that said first side of said bendable workpiece faces said first workpiece die and said second opposing side of said bendable workpiece faces said first working surface of said first working area;

a second working area disposed adjacent to said first working area and provided with a first working surface, said second working area configured to receive a second workpiece die and a second portion of said bendable workpiece between said second workpiece die and said first working surface of said second working area such that said second workpiece die is disposed on the same side of said bendable workpiece as said first workpiece die and such that said first side of said bendable workpiece faces said second workpiece die and said second opposing side of said bendable workpiece faces said first working surface of said second working area;

a support base; and a stationary first die platform assembly adjacently disposed to a movable second die platform assembly on said support base, said first working area being provided on said stationary first die platform assembly and said second working area being provided on said movable second die platform assembly;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition.

2. The apparatus of claim 1, wherein said first working area is displaceable with said first workpiece die relative to said second working area with said second workpiece die when said second portion of said bendable workpiece is received between said second workpiece die and said first working surface of said second workpiece area and when said first portion of said bendable workpiece is received between said first workpiece die and said first working surface of said first working area so as to induce said joggle in said bendable workpiece.

3. The apparatus of claim 1, wherein said bendable workpiece comprises an elongated bendable workpiece having a longitudinal axis; and wherein said second working area is displaceable with said second workpiece die relative to said first working area with said first workpiece die in a direction that is perpendicular to said longitudinal axis of said bendable workpiece when said first portion of said bendable workpiece is received between said first workpiece die and said first working surface of said first working area and when said second portion of said bendable workpiece is received between said second workpiece die and said first working surface of said second working area.

4. The apparatus of claim 1, wherein said support base is configured as a portable work table.

5. The apparatus of claim 1, further comprising a displacement indicator configured to indicate displacement of said second working area relative to said first working area.

6. The apparatus of claim 1, wherein said second working area is displaceable with said second workpiece die relative to said first working area and with said first workpiece die to induce said joggles of different configurations in bendable workpieces of different sizes and shapes.

7. A die-forming apparatus, comprising:

a first working area provided with a first working surface, said first working area configured to receive a first workpiece die and a first portion of a bendable workpiece having first and second opposing sides between said first workpiece die and said first working surface of said first working area such that said first side of said bendable workpiece faces said first workpiece die and said second opposing side of said bendable workpiece faces said first working surface of said first working area; and a second working area disposed adjacent to said first working area and provided with a first working surface, said second working area configured to receive a second workpiece die and a second portion of said bendable workpiece between said second workpiece die and said first working surface of said second working area such that said second workpiece die is disposed on the same side of said bendable workpiece as said first workpiece die and such that said first side of said bendable workpiece faces said second workpiece die and said second opposing side of said bendable workpiece faces said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition; and wherein said first working area is provided with a second working surface and is further configured to receive a third portion of said bendable workpiece between said first workpiece die and said second working surface of said first working area at the same time said first portion of said bendable workpiece is received between said first workpiece die and said first working surface; and wherein said second working area is provided with a second working surface and is further configured to receive a fourth portion of said bendable workpiece between said second workpiece die and said second working surface of said second working area at the same time said second portion of said bendable workpiece is received between said second workpiece die and said first working surface of said second working area.

8. The apparatus of claim 7, wherein said first working surface of said first working area is oriented in a plane that is perpendicular to said second working surface of said first working area; and wherein said first working surface of said second working area is oriented in a plane that is perpendicular to said second working surface of said second working area.

9. The apparatus of claim 7, wherein said bendable workpiece comprises a multi-planar bendable workpiece having at least a first section oriented in a first plane and a second section oriented in a second plane that is different than said first plane; wherein said first and second portions of said workpiece comprise parts of said first section of said workpiece and wherein said second and third portions of said workpiece comprise parts of said second section of said workpiece; and wherein said apparatus is configured to simultaneously induce bends of substantially equal angular and linear displacement in each of said first and second sections of said multiplanar workpiece when said second working area is displaced relative to said first working area.

10. A die-forming apparatus, comprising:

a first working area provided with a first working surface, said first working area configured to receive a first workpiece die and a first portion of a bendable workpiece having first and second opposing sides between said first workpiece die and said first working surface of said first working area such that said first side of said bendable workpiece faces said first workpiece die and said second opposing side of said bendable workpiece faces said first working surface of said first working area; and a second working area disposed adjacent to said first working area and provided with a first working surface, said second working area configured to receive a second workpiece die and a second portion of said bendable workpiece between said second workpiece die and said first working surface of said second working area such that said second workpiece die is disposed on the same side of said bendable workpiece as said first workpiece die and such that said first side of said bendable workpiece faces said second workpiece die and said second opposing side of said bendable workpiece faces said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition; and wherein an opening is defined on at least one side of said first working area, said opening of said first working area being configured to receive both said bendable workpiece and said first workpiece die; wherein an opening is defined on at least one side of said second working area, said opening of said second working area being configured to receive both said bendable workpiece and said second workpiece die; and wherein said opening of each of said first and second working areas is configured to remain open at the same time said second working area is displaced relative to said first working area with said bendable workpiece received therein so as to induce said joggle in said bendable workpiece.

11. The apparatus of claim 10, wherein each of said first and second working areas is configured with a channel shape having a channel opening on one side to receive both said bendable workpiece and one of said first and second workpiece dies within said channel; and wherein said channel opening of each of said first and second working areas is configured to remain open at the same time said second working area is displaced relative to said first working area with said bendable workpiece received within said channel so as to induce said joggle in said bendable workpiece.

12. A die-forming apparatus, comprising:

a first working area provided with a first working surface, said first working area configured to receive a first workpiece die and a first portion of a bendable workpiece having first and second opposing sides between said first workpiece die and said first working surface of said first working area such that said first side of said bendable workpiece faces said first workpiece die and said second opposing side of said bendable workpiece faces said first working surface of said first working area; and a second working area disposed adjacent to said first working area and provided with a first working surface, said second working area configured to receive a second workpiece die and a second portion of said bendable workpiece between said second workpiece die and said first working surface of said second working area such that said second workpiece die is disposed on the same side of said bendable workpiece as said first workpiece die and such that said first side of said bendable workpiece faces said second workpiece die and said second opposing side of said bendable workpiece faces said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition; and further comprising a die platform drive assembly configured to displace said second working area with said second workpiece die without press equipment relative to said first working area with said first workpiece die when said first portion of said bendable workpiece is received between said first workpiece die and said first working surface of said first working area to induce said joggle in said bendable workpiece.

13. A die-forming apparatus, comprising:

a first die platform, said first die platform comprising a first working member and a first securing member oriented in spaced relationship with said first working member so as to define a first working area therebetween;

a second die platform disposed adjacent to said first die platform, said second die platform comprising a second working member and a second securing member oriented in spaced relationship with said second working member so as to define a second working area therebetween;

at least one workpiece die configured to be positioned within at least one of said first and second working areas;

wherein at least one of said first and second die platforms is movable relative to the other of said first and second die platforms so that said first and second working areas are positionable in an aligned relationship with each other;

wherein at least one of said first and second die platforms is movable relative to the other of said first and second die platforms so that said first and second working areas are positionable from said aligned relationship to a non-aligned relationship with each other;

wherein said at least one workpiece die comprises a first workpiece die configured to be positioned within said first working area between said first securing member and said first working member; and a second workpiece die configured to be positioned within said second working area between said second securing member and said first working member;

wherein said first workpiece die is configured to be positioned within said first working area between said first securing member and said first working member, said first workpiece die being configured to secure a first portion of a bendable workpiece against a side working surface of said first working member; and wherein said second workpiece die is configured to be positioned within said second working area between said second securing member and said second working member, said second workpiece die being configured to secure a second portion of said bendable workpiece against a side working surface of said second working member;

wherein at least one of said first and second die platforms is movable relative to the other of said first and second die platforms so that said first and second working areas are positionable in said aligned relationship with each other to accept an unbent bendable workpiece; and wherein at least one of said first and second die platforms is movable relative to the other of said first and second die platforms so that said first and second working areas are positionable from said aligned relationship to said non-aligned relationship with each other to induce a bend in said bendable workpiece;

wherein an opening is defined on at least one side of said first working area, said opening of said first working area being configured to receive both said bendable workpiece and said first workpiece die;

wherein an opening is defined on at least one side of said second working area, said opening of said second working area being configured to receive both said bendable workpiece and said second workpiece die; and wherein said opening of each of said first and second working areas is configured to remain open at the same time said first and second working areas are positioned from said aligned relationship to said non-aligned relationship with each other to induce a bend in said bendable workpiece.

14. A die-forming apparatus, comprising:

a first working area provided with a first working surface, said first working area configured to receive a first workpiece die and a first portion of a bendable workpiece between said first workpiece die and said first working surface of said first working area; and a second working area disposed adjacent to said first working area and provided with a first working surface, said second working area configured to receive a second workpiece die and a second portion of said bendable workpiece between said second workpiece die and said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area so as to induce a bend in said bendable workpiece;

wherein an opening is defined on at least one side of said first working area, said opening of said first working area being configured to receive both said bendable workpiece and said first workpiece die;

wherein an opening is defined on at least one side of said second working area, said opening of said second working area being configured to receive both said bendable workpiece and said second workpiece die; and wherein said opening of each of said first and second working areas is configured to remain open at the same time said second working area is displaced relative to said first working area with said bendable workpiece received therein so as to induce a bend in said bendable workpiece.

15. The apparatus of claim 14, wherein each of said first and second working areas is configured with a channel shape having a channel opening on one side to receive both said bendable workpiece and one of said first and second workpiece dies within said channel; and wherein said channel opening of each of said first and second working areas is configured to remain open at the same time said second working area is displaced relative to said first working area with said bendable workpiece received within said channel so as to induce a bend in said bendable workpiece.

16. A method of die-forming a bendable workpiece, comprising:

positioning said bendable workpiece within first and second working areas, said second working area being disposed adjacent to said first working area, a first portion of said bendable workpiece being positioned between a first workpiece die and a first working surface of said first working area, and a second portion of said bendable workpiece being positioned between a second workpiece die and a first working surface of said second working area;

inducing a bend in said bendable workpiece by displacing said second working area relative to said first working area with said first portion of said bendable workpiece positioned between said first workpiece die and said first working surface of said first working area, and with said second portion of said bendable workpiece positioned between said second workpiece die and said first working surface of said second working area;

wherein an opening is defined on at least one side of said first working area, said opening of said first working area being configured to receive both said bendable workpiece and said first workpiece die;

wherein an opening is defined on at least one side of said second working area, said opening of said second working area being configured to receive both said bendable workpiece and said second workpiece die; and wherein said method further comprises leaving said opening of each of said first and second working areas open on said at least one side while inducing a bend in said bendable workpiece by displacing said second working area relative to said first working area.

17. The method of claim 16, wherein each of said first and second working areas is configured with a channel shape having a channel opening on one side to receive both said bendable workpiece and one of said first and second workpiece dies within said channel; and wherein said method further comprises leaving said channel opening of each of said first and second work areas open while inducing a bend in said bendable workpiece by displacing said second working area relative to said first working area.

18. A die-forming apparatus, comprising:

a first working area provided with a first working surface, said first working area configured to receive a first workpiece die and a first portion of a bendable workpiece between said first workpiece die and said first working surface of said first working area; and a second working area disposed adjacent to said first working area and provided with a first working surface, said second working area configured to receive a second workpiece die and a second portion of said bendable workpiece between said second workpiece die and said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition;

wherein said first working area is provided with a second working surface and is further configured to receive a third portion of said bendable workpiece between said first workpiece die and said second working surface of said first working area at the same time said first portion of said bendable workpiece is received between said first workpiece die and said first working surface; and wherein said second working area is provided with a second working surface and is further configured to receive a fourth portion of said bendable workpiece between said second workpiece die and said second working surface of said second working area at the same time said second portion of said bendable workpiece is received between said second workpiece die and said first working surface of said second working area.

19. The apparatus of claim 18, wherein said first working surface of said first working area is oriented in a plane that is perpendicular to said second working surface of said first working area; and wherein said first working surface of said second working area is oriented in a plane that is perpendicular to said second working surface of said second working area.

20. The apparatus of claim 18, wherein said bendable workpiece comprises a multi-planar bendable workpiece having at least a first section oriented in a first plane and a second section oriented in a second plane that is different than said first plane; wherein said first and second portions of said workpiece comprise parts of said first section of said workpiece and wherein said second and third portions of said workpiece comprise parts of said second section of said workpiece; and wherein said apparatus is configured to simultaneously induce bends of substantially equal angular and linear displacement in each of said first and second sections of said multiplanar workpiece when said second working area is displaced relative to said first working area.

21. The apparatus of claim 18, where the first and second workpiece dies are configured such that the width of the gap between said first workpiece die and said second workpiece die is changeable to vary the length of said induced joggle transition.

22. A die-forming apparatus, comprising:

a first working area provided with a first working surface, said first working area configured to receive a first workpiece die and a first portion of a bendable workpiece between said first workpiece die and said first working surface of said first working area; and a second working area disposed adjacent to said first working area and provided with a first working surface, said second working area configured to receive a second workpiece die and a second portion of said bendable workpiece between said second workpiece die and said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce joggle having a joggle transition in said bendable workpiece, a width of said gap between said first workpiece die and said second workpiece die corresponding to a length and location of said joggle transition; and wherein said die-forming apparatus further comprises a die platform drive assembly configured to displace said second working area with said second workpiece die without press equipment relative to said first working area with said first workpiece die when said first portion of said bendable workpiece is received between said first workpiece die and said first working surface of said first working area to induce said joggle in said bendable workpiece.

23. The apparatus of claim 22, where the first and second workpiece dies are configured such that the width of the gap between said first workpiece die and said second workpiece die is changeable to vary the length of said induced joggle transition.

24. A die-forming apparatus, comprising:

a first working area provided with a first working surface, said first working area configured to receive a first workpiece die and a first portion of a bendable workpiece having first and second opposing sides between said first workpiece die and said first working surface of said first working area such that said first side of said bendable workpiece faces said first workpiece die and said second opposing side of said bendable workpiece faces said first working surface of said first working area; and a second working area disposed adjacent to said first working area and provided with a first working surface, said second working area configured to receive a second workpiece die and a second portion of said bendable workpiece between said second workpiece die and said first working surface of said second working area such that said second workpiece die is disposed on the same side of said bendable workpiece as said first workpiece die and such that said first side of said bendable workpiece faces said second workpiece die and said second opposing side of said bendable workpiece faces said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition; and where the first and second workpiece dies are configured such that the width of the gap between said first workpiece die and said second workpiece die is changeable to vary the length of said induced joggle transition.

25. A die-forming apparatus, comprising:

a first working area provided with a first working surface, said first working area configured to receive a first workpiece die and a first portion of a bendable workpiece between said first workpiece die and said first working surface of said first working area; and a second working area disposed adjacent to said first working area and provided with a first working surface, said second working area configured to receive a second workpiece die and a second portion of said bendable workpiece between said second workpiece die and said first working surface of said second working area;

wherein said second working area is displaceable with said second workpiece die relative to said first working area with said first workpiece die when said first portion of said bendable workpiece is received between said first workpiece die and said first working surface of said first working area, and when said second portion of said bendable workpiece is received between said second workpiece die and said first working surface of said second working area with a gap existing between said first workpiece die and said second workpiece die so as to induce a joggle having a joggle transition in said bendable workpiece, a width of said gap between said first workpiece die and said second workpiece die corresponding to a length and location of said joggle transition;

wherein said second working area is displaceable with said second workpiece die relative to said first working area and with said first workpiece die to induce said joggles of different configurations in bendable workpieces of different sizes and shapes; and where the first and second workpiece dies are configured such that the width of the gap between said first workpiece die and said second workpiece die is changeable to vary the length of said induced joggle transition.

* * * * *